US006325478B1

(12) United States Patent
Imai et al.

(10) Patent No.: US 6,325,478 B1
(45) Date of Patent: Dec. 4, 2001

(54) PRINTING DEVICE WITH PRINT DENSITY CHANGING FUNCTION

(75) Inventors: Koji Imai; Shin Hasegawa, both of Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/058,824

(22) Filed: Apr. 13, 1998

(30) Foreign Application Priority Data

Apr. 15, 1997 (JP) ..... 9-114367
Apr. 15, 1997 (JP) ..... 9-114368

(51) Int. Cl.[7] ..... B41J 2/205

(52) U.S. Cl. ..... 347/15; 347/10; 347/11; 347/14; 358/1.9; 358/502

(58) Field of Search ..... 347/11, 15, 69, 347/10, 9, 5, 14, 19, 2; 358/1.9, 1.15, 434, 435, 436, 501, 502

(56) References Cited

U.S. PATENT DOCUMENTS 4,544,931 * 10/1985 Watanabe et al. ..... 347/17
4,618,869 * 10/1986 Kotani et al. ..... 347/9
4,684,960 * 8/1987 Nishiwaki ..... 347/197
4,774,528 * 9/1988 Kato ..... 347/183
4,879,568 11/1989 Bartky et al. ..... 347/69
4,885,597 * 12/1989 Tschang et al. ..... 347/237
4,887,100 12/1989 Michaelis et al. ..... 347/69
4,910,528 * 3/1990 Firl et al. ..... 347/17
4,992,808 2/1991 Bartky et al. ..... 347/69
5,003,679 4/1991 Bartky et al. ..... 29/25.35
5,028,936 7/1991 Bartky et al. ..... 347/69
5,033,679 7/1991 Golev et al. ..... 239/533.3
5,146,236 * 9/1992 Hirata et al. ..... 347/12
5,252,986 * 10/1993 Takaoka et al. ..... 347/15
5,367,325 * 11/1994 Yano et al. ..... 347/17
5,477,245 * 12/1995 Fuse ..... 347/10
5,521,622 * 5/1996 Hock et al. ..... 347/43
5,714,989 * 2/1998 Wade ..... 347/14
5,745,132 * 4/1998 Hirabayashi et al. ..... 347/14
5,923,345 * 7/1999 Imai ..... 347/11
6,007,174 * 12/1999 Hirabayashi et al. ..... 347/14
6,126,263 * 10/2000 Hotomi et al. ..... 347/15

FOREIGN PATENT DOCUMENTS

A-63-247051 * 10/1988 (JP) .
08090777-A * 4/1996 (JP) .

* cited by examiner

*Primary Examiner*—John Barlow
*Assistant Examiner*—Blaise Mouttet
(74) *Attorney, Agent, or Firm*—Oliff & Berridge, PLC

(57) ABSTRACT

When the printing instruction is issued in S100, it is judged in S110 whether the present mode is the printer mode. When the present mode is not set to the printer mode, it is judged in S120 whether the present mode is set to the facsimile mode. When the present mode is set to the facsimile mode, the driving waveform of the driving signal is set in S130 into a multi-pulse, comprised of two pulses, for every single set of print data. In S140, printing operation is performed with the multi-pulse driving signal. Accordingly, ink droplets are ejected twice from a single nozzle for a single set of data. Thus, the print density of the obtained image is increased.

20 Claims, 14 Drawing Sheets

PRINTER MODE

FACSIMILE MODE

PRINTER MODE

FACSIMILE MODE

PRINTING DEVICE WITH PRINT DENSITY CHANGING FUNCTION

BACKGROUND OF THE INVENTION

1. Field of the Invention

The present invention relates to a printing device for printing desired images through controlling a print head.

2. Description of the Related Art

An ink-jet printing device has been proposed to print desired images through controlling an ink-jet print head.

SUMMARY OF THE INVENTION

It is conceivable to provide an ink-jet printing device which can perform both a printing function and a facsimile function.

The conceivable ink-jet printing device has an ink-jet print head for selectively ejecting ink droplets of four colors: cyan, magenta, yellow, and black onto print papers. When print data received from a host computer is for designating full color printing, the print head performs full color printing to selectively eject ink of the four colors. When facsimile data is received through a communication circuit, on the other hand, the print head performs monochromatic printing to eject ink of black color only.

The print head is designed to eject ink droplets through nozzles onto a print paper and to create ink dots on the print paper. The size of each dot, produced on the print paper, is determined dependent on the amount of ink included in each ink droplet ejected from one nozzle.

FIG. 1A shows an ink dot 100 created on the printing paper through the monochromatic printing operation. That is, the print head ejects a single droplet of black ink from one nozzle according to one dot's worth of print data (one set of print data). The ink droplet permeates through the printing paper, spreads on the paper surface, and creates the ink dot 100 shown in FIG. 1A.

FIG. 1B shows another ink dot 200 created on the printing paper through the full color printing operation. During the full color printing operation, when color represented by a single dot's worth of print data is other than the four colors: black, cyan, yellow, and magenta, the print head uses two different colors to reproduce that color. That is, in order to reproduce the subject color, the print head ejects two droplets of different colors from different nozzles onto the same location on the paper. The two ink droplets permeate through the printing paper, spread on the paper surface, and create the two droplet-combined dot 200 shown in FIG. 1B. It is noted that when color represented by the single dot's worth of print data is either black, cyan, yellow, or magenta, the print head uses only a single ink droplet in the same manner as during the monochromatic printing operatoin. Accordingly, the single droplet-forming dot 100 of FIG. 1A is created to reproduce that color.

Thus, during the monochromatic printing operation, each dot 100 is created from a single ink droplet having one dot's worth of ink amount. Accordingly, each dot 100 is made from ink with one dot's worth of amount. A monochromatic image will be produced as made from a plurality of dots 100. During the full color printing operation, on the other hand, dots 100 and dots 200 will be created to print a full-color image. Each dot 100 is created from a single ink droplet, and therefore is made from ink with one dot's worth of amount. Each dot 200 is created from two ink droplets of different colors, each having one dot's worth of ink amount. The dot 200 is therefore made from ink with two dots' worth of amount. The dot 200 has a larger size than the dot 100.

In order to perform both the monochromatic printing operation and the full color printing operation, the one dot's worth of ink amount is preferably selected to such a value that a full-color solid image 210 will be produced only from the two droplet-combined dots 200 shown in FIG. 2 while forming no spaces among the respective dots 200. The print head is therefore designed so as to be capable of ejecting, from each nozzle, a single ink droplet comprised of ink with the thus set one dot's worth of ink amount.

The thus designed print head prints a monochromatic solid image 110 also shown in FIG. 2 through the monochromatic printing operation. The monochromatic solid image 110 is made from a plurality of single droplet-forming dots 100 of FIG. 1A. Because the dots 100 are smaller in size than the dots 200, spaces 102 are formed among the respective dots 100. Accordingly, the monochromatic solid image 110 presents print density lower than that presented by the full-color solid image 210.

In view of the above, it is an object of the present invention to provide a printing device which can print monochromatic images, through monochromatic printing operation, at desirable print density.

In order to attain the above and other objects, the present invention provides a printing device capable of printing desired print information onto print medium, the device comprising: input means for receiving print information desired to be printed; print means for printing the received print information on a print medium; and density control means for controlling the print means to print the received print information at a print density while selectively controlling the print density into either a first print density or a second print density different from the first print density.

The printing device may further comprise judging means for judging whether the received print information is of a first type or of a second type different from the first type, the density control means controlling the print means to perform printing operation while controlling the print density, the density control means controlling the print means to print the received print information at the first print density when the received print information is judged to be of the first type, the density control means controlling the print means to print the received print information at the second print density when the received print information is judged to be of the second type, the second print density being different from the first print density.

According to another aspect, the present invention provides a printing device capable of printing desired print information onto print medium both in a single color and in a plurality of colors, the device comprising: input means for receiving print information desired to be printed; judging means for judging whether the received print information is of a first type print information which includes image information to be printed with a plurality of colors and image information to be printed with a single predetermined color or of a second type print information to be printed with the single predetermined color; print density adjusting means for adjusting print density of the predetermined color into first print density when the received print information is judged to be the first type and for adjusting print density of the predetermined color into second print density when the received print information is judged to be the second type, the second print density being higher than the first print density; and print means for printing the predetermined color of the received first type of print information at the first printing density and for printing the predetermined color of the received second type of print information at the second printing density.

According to a further aspect, the present invention provides a printing device, comprising: input means for receiving print information; a print head for being driven, in response to a driving pulse signal, to print the received print information onto print medium; driving means for selectively supplying either first driving pulse signals or second driving pulse signals to the print head in correspondence with successive sets of print information, each first driving pulse signal for printing a corresponding set of print information being comprised of at least one pulse, the second driving pulse signal for printing a corresponding set of print information being comprised of a plurality of successive pulses, the number of the pulses in the second driving pulse signal being greater than the number of pulses, of which there are at least one, in the first driving pulse signal; and frequency control means for controlling a second frequency, at which the driving means supplies the successive second driving pulse signals to the print head, to be lower than a first frequency, at which the driving means supplies the successive first driving pulse signals.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1A:
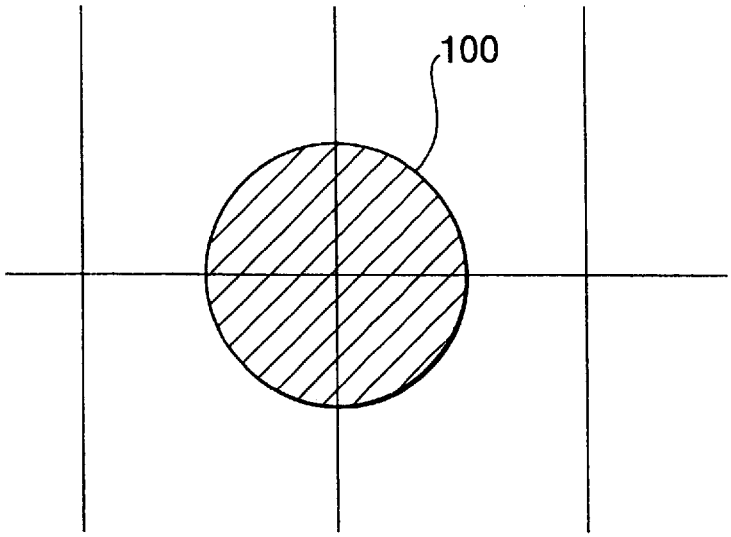
FIG. 1A illustrates a single ink dot formed on a print paper, the single ink dot being made from a single black ink droplet ejected from a nozzle according to one dot's worth of print data.

An ink-jet printing device according to preferred embodiments of the present invention will be described while referring to the accompanying drawings wherein like parts and components are designated by the same reference numerals to avoid duplicating description.

Figure 3:
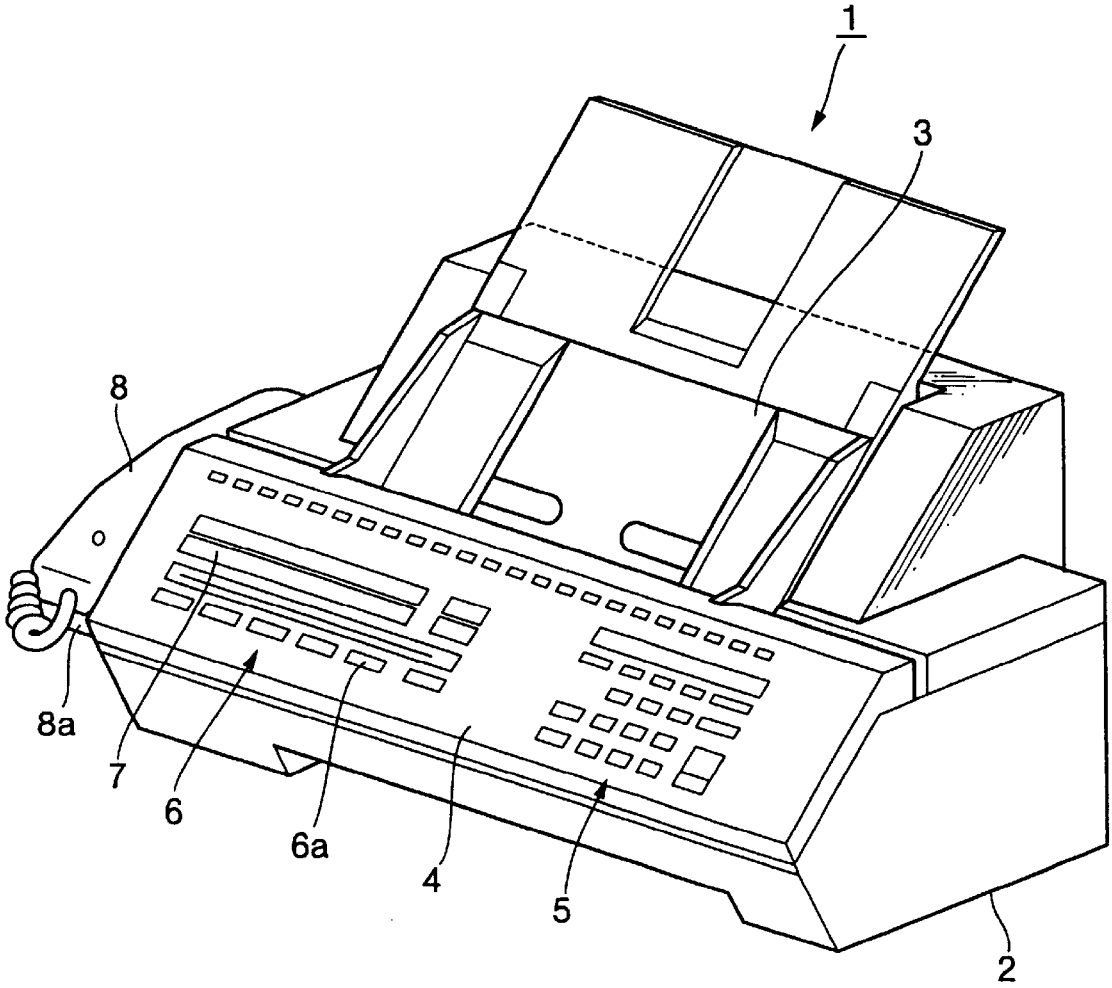
FIG. 3 is an external perspective view of a printing device of a preferred first embodiment of the present invention.

FIG. 3 is an external perspective view of a printing device of a first embodiment of the present invention.

Directional terms, such as up, down, right, and left will be used in the following description with reference to the state of the printing device 1 located in an orientation shown in FIG. 3.

This printing device 1 is an ink-jet printing device of a multifunction type which can perform both facsimile operation and printing operation.

The printing device 1 mainly includes a housing 2 and an original stand 3 provided on the upper surface of the housing 2. The original stand 3 is for mounting thereon an original, the information of which is desired to be transmitted to remote facsimile machines. An operation panel 4 is provided to the front exterior surface of the housing 2. The operation panel 4 is provided with: a numerical pad 5 for designating a telephone number of a remote facsimile machine, to which the information on the original is desired to be transmitted; several operation keys 6 for designating start and stop of transmission; and a liquid crystal display 7 for displaying facsimile transmission states, an operator's inputted telephone number of the remote facsimile machine, and the like. The operation keys 6 include a switch key 6*a* for switching between a facsimile mode and a printer mode. A handset mount 8*a* is provided to the left side surface of the housing 2. A handset 8 is mounted on the handset mount 8*a*.

The internal structure of the printing device 1 will be described below with reference FIG. 4.

The printing device 1 can perform printing operation onto a printing paper P. The printing device 1 includes a paper supply cassette (not shown) for containing printing papers P to be fed into the printing device 1; a platen roller 12 for guiding the printing paper P inward in a direction F1 during the printing operation and expelling the printing paper P outward in another direction F2 when the printing operation is completed; an ink-jet print head unit 20 capable of printing color ink on the printing paper P; a carriage 29 for supporting the ink-jet print head unit 20 near the platen roller 12 and for moving the ink-jet print head unit 20 in a direction parallel to the platen roller 12 during the printing process; a flushing pad 30 disposed near to one end of the platen roller 12 for absorbing ink ejected from the ink-jet print head unit 20 during a flushing operation; a purge device 31 disposed near to the other end of the platen roller 12 for removing inferior ink from the ink-jet print head unit 20; a wiper device 35 for removing ink drops and foreign matter from the nozzle surface of the ink-jet print head unit 20; and a capping device 36 for covering the nozzle surface of the ink-jet print head unit 20 to prevent the nozzle surface from being dried.

The paper supply cassette (not shown) is disposed in the back of the printing device 1 in the lower side of the original mount 3. The paper supply cassette contains a plurality of sheets of printing paper P. During a printing operation, one printing paper P is fed at a time into a printing section, where the ink-jet print head unit 20 is movably provided with respect to the platen roller 12. The platen roller 12 is freely rotatable and is disposed in opposition to the front surface of the ink-jet print head unit 20 and parallel to the transport path of the same. Here, the transport path indicates the path along which the ink-jet print head unit 20 is moved during printing operations.

Figure 4:
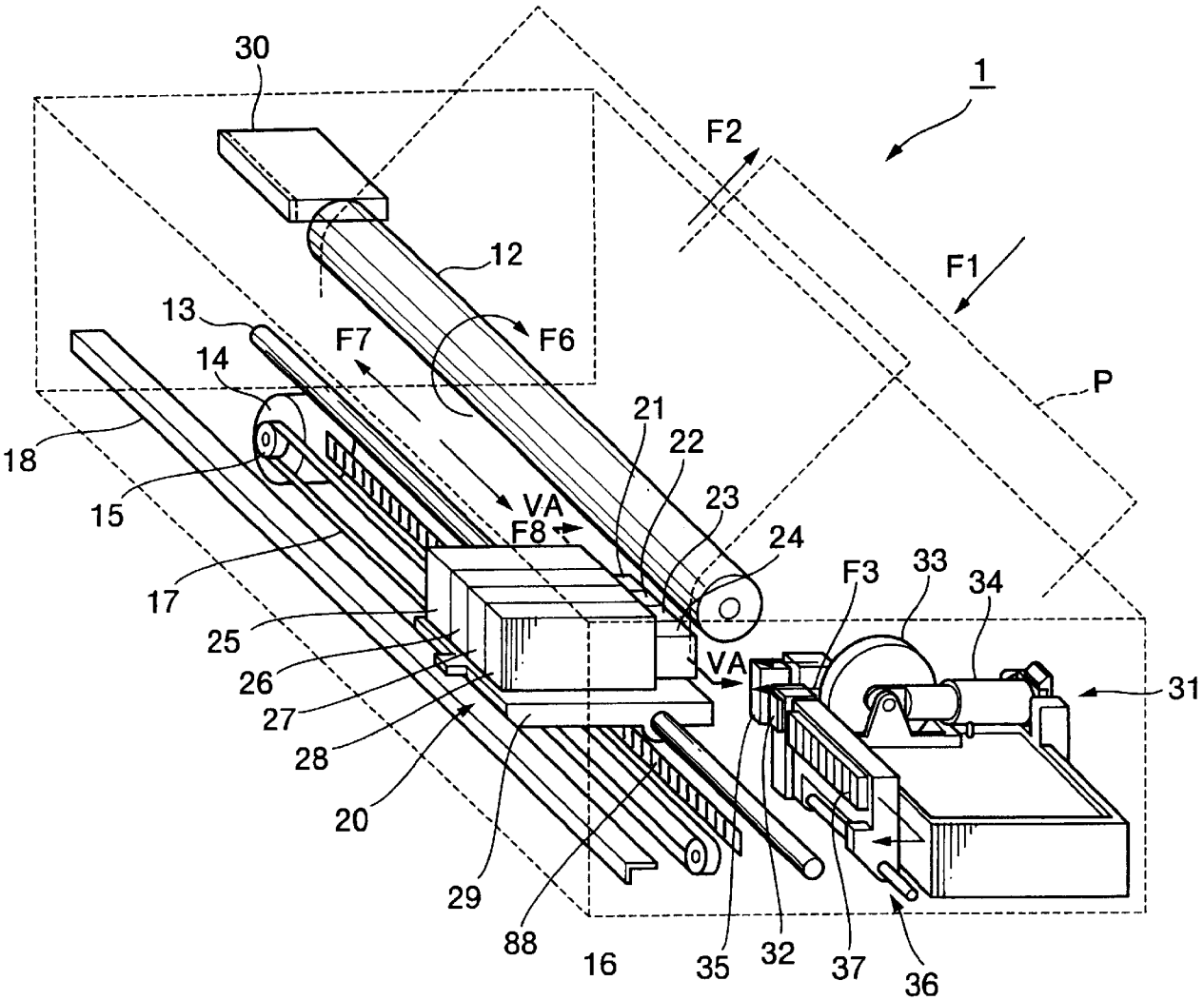
FIG. 4 illustrates an internal structure of the printing device of FIG. 3.

During a printing operation, the printing paper P is guided between the ink-jet print head unit 20 and the platen roller 12, which is driven to rotate in a direction F6 indicated by an arrow in FIG. 4. It is noted that the feeding mechanism for feeding the printing paper P has been omitted from the drawing.

The carriage 29 is provided for supporting the ink-jet print head unit 20. In order to support the carriage 29, a carriage shaft 13 is disposed parallel to and extending along the transport path of the ink-jet print head unit 20; and a guide plate 18 is disposed parallel to the carriage shaft 13. Thus, the carriage shaft 13 and the guide plate 18 extend along the platen roller 12. The carriage 29 is slidably supported on the carriage shaft 13 and on the guide plate 18. Further, pulleys 15 and 16 are disposed approximately one on each end of the carriage shaft 13. That is, the pulleys 15 and 16 are provided near to the left and right ends of the carriage shaft 13. An endless belt 17 for moving the carriage 29 in the transport path parallel to the platen roller 12 is stretched around the pulleys 15 and 16, linking them together, and is attached to the carriage 29. A drive shaft of a motor 14 is connected to the pulley 15 to rotate the pulley 15, thereby moving the belt 17 and conveying the carriage 29 along the transport path.

Figure 7:
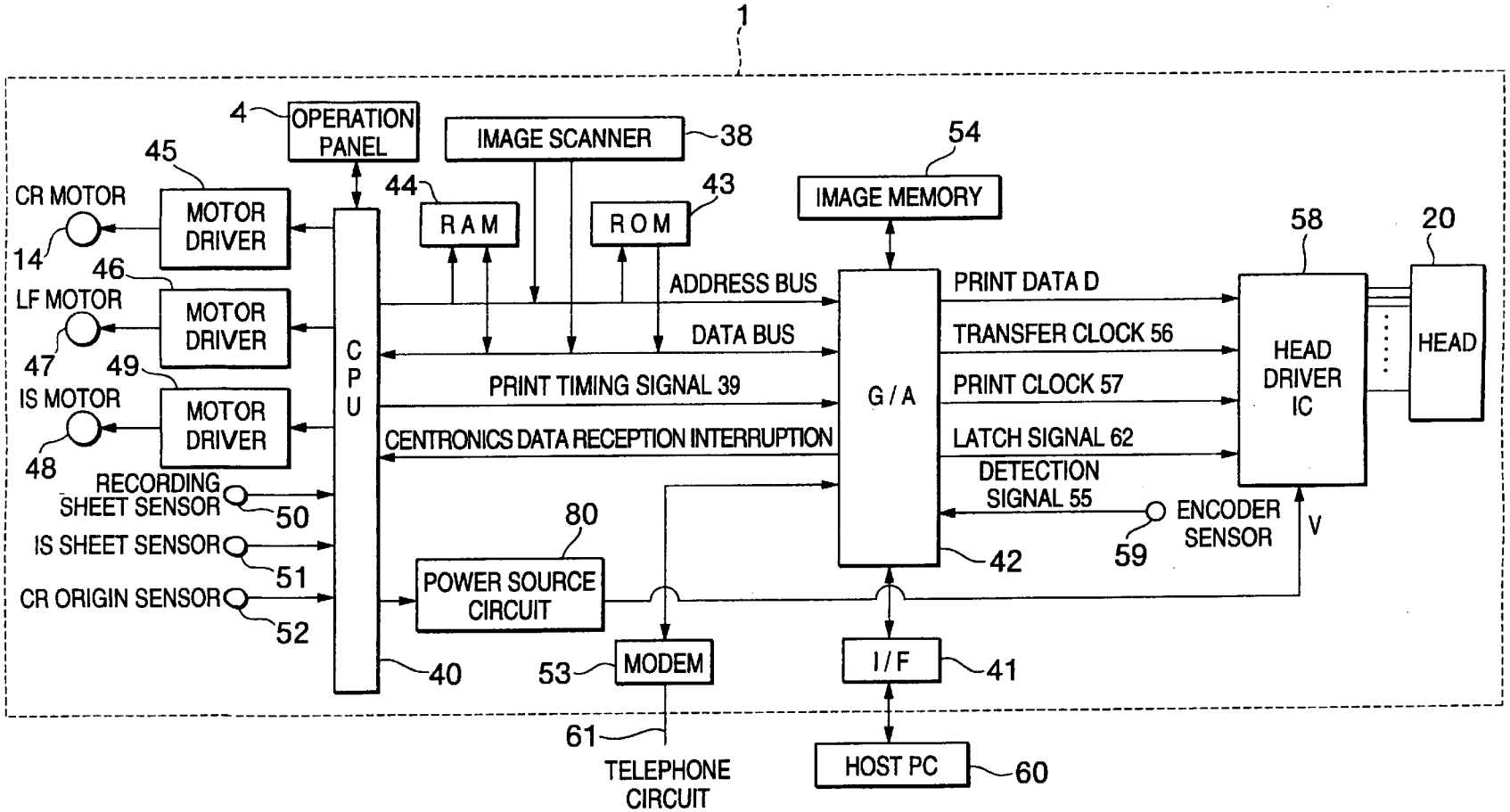
FIG. 7 is a block diagram of a control system employed in the printing device of FIG. 3.

An elongated position-indicating member 88 is provided to extend in the moving direction of the carriage 29. The position-indicating member 88 is formed with a plurality of marks along its length. As shown in FIG. 7, an encoder sensor 59 is mounted to the carriage 29. The e coder sensor 59 is for reading the marks formed on the position-indicating member 88 as the carriage 29 moves along the moving direction. The encoder sensor 59 outputs signals 55 indicative of the position of the carriage 29 as the carriage 29 moves. More specifically, the encoder sensor 59 outputs detection signals 55 when detecting the marks formed on the position-indicating member 88. The frequency of the detection signals 55 therefore corresponds to the moving speed of the carriage 29.

The ink-jet print head unit 20 is mounted on the carriage 29 and is moved in the transport path in the directions F7 and F8 parallel to the platen roller 12. The ink-jet print head unit 20 can print images on the printing paper P in four colors: black, yellow, cyan, and magenta. The print head unit 20 is constructed from four ink-jet print heads 21–24. The ink-jet print head 21 is a black color ink head for ejecting black color ink, the ink-jet print head 22 is an yellow color ink head for ejecting yellow color ink, the ink-jet print head 22 is a cyan color ink head for ejecting cyan color ink, and the ink-jet print head 23 is a magenta color ink head for ejecting magenta color ink. The ink cartridges 25–28 are provided for supplying black color ink, yellow color ink, cyan color ink, and magenta color ink to the ink-jet print heads 21–24, respectively. Each of the ink-jet print heads 21–24 is connected in fluid communication with a corresponding ink cartridge 25–28.

In this way, the movement of the carriage 29 and the movement of the recording paper P cooperate to print desired images on the recording paper P through controlling the ink-jet print head unit 20 to eject color ink on desired areas of the recording paper P.

The ink absorbing pad 30 is provided at a position, which is near to the left end portion of the platen roller 12 and which is outside of a printing region on which the printing operation is performed. When the ink-jet print head unit 20 is moved to a left end of the transport path, the ink-jet print heads 21–24 are controlled to perform a flushing operation. Ink ejected from the ink-jet print heads 21–24 is absorbed by the ink absorbing pad 30. The pad 30 is made from porous material.

The purge device 31 is disposed at a position, which is near to the right end of the platen roller 12 and which is also outside of the printing region. The purge device 31 is positioned opposite to a reset position for each of the ink-jet print heads 21–24. Here, the reset position indicates the position where each ink-jet print head is located to be subjected to a purging operation. The purge device 31 is provided for removing, through suction, ink containing air bubbles in each ink-jet print head and causing the ink-jet print head to restore its good quality ejection condition. In the purge device 31, a cap 32 is disposed in front of and opposing the reset position of the ink-jet print head. A pump 34 is provided to develop a negative pressure, thereby sucking a predetermined amount of inferior ink, such as ink containing air bubbles, from the inside of the ink-jet print head. A cam 33 is provided to move the suction cap 32 in a direction F3 to cover the nozzle surface of the ink-jet print head and to drive the pump 34.

When the carriage 29 carries the ink-jet print head unit 20 so that one ink-jet print head, desired to be subjected to the purge operation, is brought into the reset position, the cap 32 is moved in the direction F3 to cover the nozzle surface of the ink-jet print head. The pump 34 is driven to remove, through suction, inferior ink from the inside of the ink-jet print head.

The wiper device 35 is provided in the left side of the suction cap 32. The wiper device 35 is for wiping off ink drops and foreign matter deposited on the nozzle surface of the ink-jet print head which has been subjected to the purging operation by the purging device 31.

The capping device 36 is provided in the right side of the suction cap 32 opposing a home position for the ink-jet print head unit 20. That is, the capping device 36 is provided with four caps 37 for covering the nozzle surfaces of all the ink-jet print heads 21–24, thereby preventing the nozzle surfaces from being dried while the print head unit 20 is rest in the home position.

Each of the ink-jet print heads 21–24 is a shear mode type drop-on-demand ink-jet print head made of piezoelectric ceramics. Representative examples of the shear mode type drop-on-demand ink-jet print head are shown in U.S. Pat. Nos. 4,887,100, 4,879,568, 4,992,808, 5,003,679, and 5,028,936.

The structure of the print head 21 will be described below in greater detail with reference to FIGS. 5A–6. The structure of each of the remaining print heads 22–24 is the same as that of the print head 21.

Figure 5A:
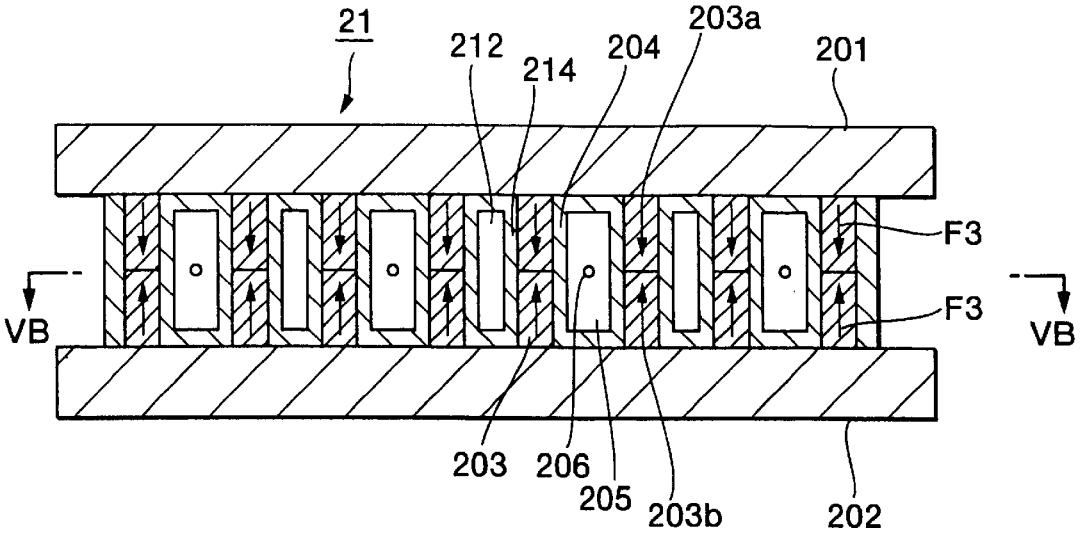
FIG. 5A is a side sectional view of an essential part of one print head employed in the printing device of FIG. 3 and taken along a line VA—VA.
Figure 5B:
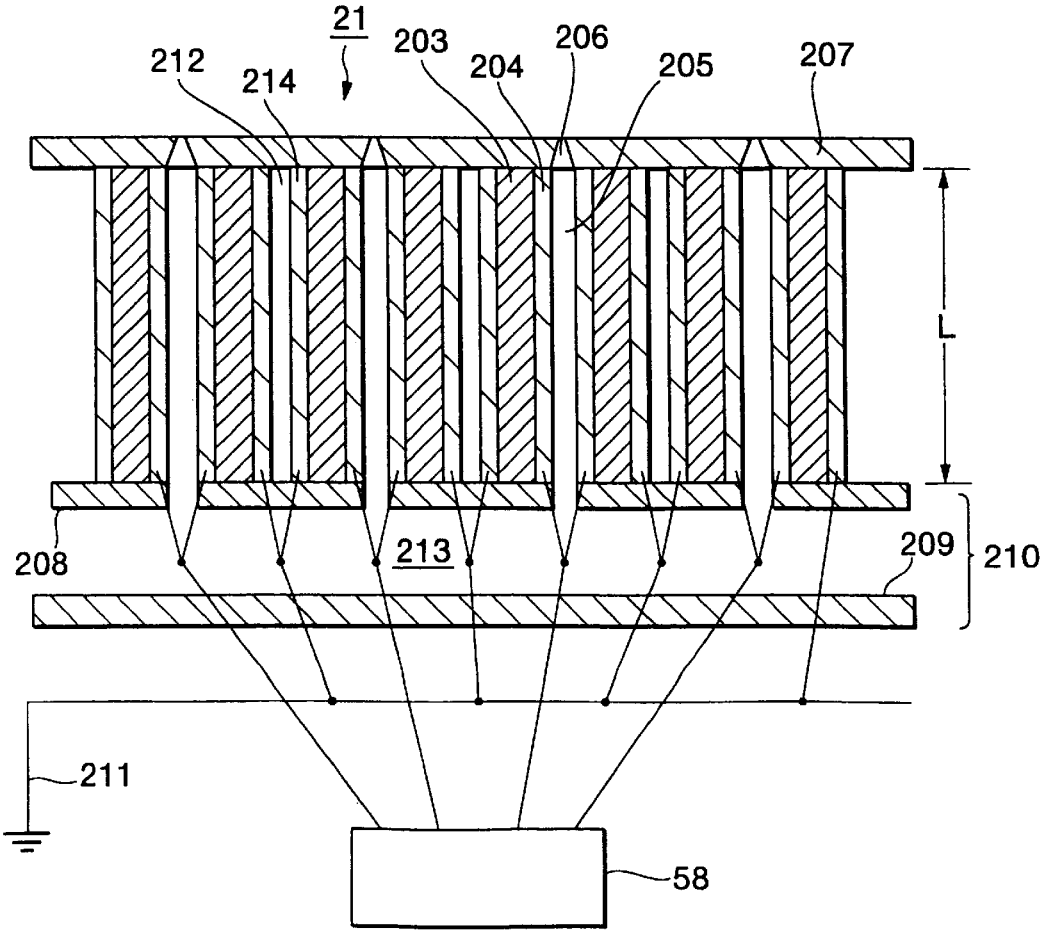
FIG. 5B is a cross-sectional view of the essential part of the print head taken along a line VB—VB.
Figure 6:
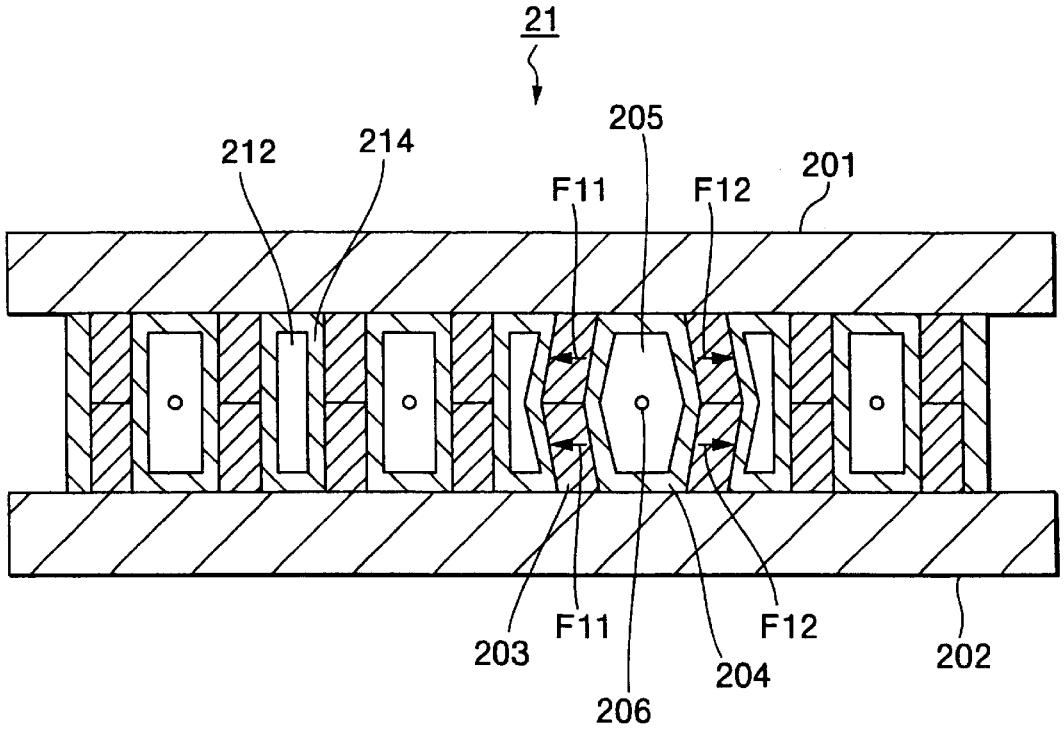
FIG. 6 illustrates how the volume of a certain one channel in FIG. 5A is increased.

FIG. 5A is a side sectional view of an essential part of the print head 21 taken along a line VA—VA in FIG. 4. FIG. 5B is a cross-sectional view of the essential part of the print head 21 taken along a line VB—VB in FIG. 5A. FIG. 5B shows not only the internal structure of the print head 21, but also the electrical connection between the print head 21 and a head driver IC 58. FIG. 6 corresponds to FIG. 5A and illustrates the state how the volume of a certain channel in the print head 21 increases.

As shown in FIG. 5A, the print head 21 is provided with: a cover plate 201 and a base plate 202 positioned opposed to the cover plate 201. A plurality of shear-mode actuator walls 203 are provided between the cover plate 201 and the base plate 202. The shear-mode actuator walls 203 are made of piezoelectric ceramics. Each actuator wall 203 is comprised of two actuator portions 203*a* and 203*b* whose polarity are opposite to each other, and serves as an actuator. The shear-mode actuator walls 203 are arranged with a space being formed between each two neighboring walls 203. The thus created plurality of spaces include a plurality of normal channels 205 and a plurality of dummy channels (spaces) 212 which are arranged in alternation. In this example, 64 channels 205 are provided in the ink-jet print head 21.

A film-shaped electrode 204 is formed entirely over the inner surface of each channel 205. That is, an electrode 204 is provided entirely covering the bottom, upper, and opposite side surfaces of the channel 205. The opposite side surfaces of the channel 205 are defined as opposing side surfaces of the two actuator walls 203 that sandwich the subject channel 205 therebetween. Another film-shaped electrode 214 is formed entirely over the inner surface of each dummy channel (space) 212. That is, an electrode 214 is provided entirely covering the bottom, upper, and opposite side surfaces of the space 212. The opposite side surfaces of the space 212 are defined as opposing side surfaces of two actuator walls 203 that sandwich the subject space 212 therebetween.

As shown in FIG. 5B, a nozzle plate 207 is attached to the front end surfaces of all the actuator walls 203. The nozzle plate 207 is formed with a plurality of nozzles 206 in fluid communication with the plurality of channels 205. A manifold 210 is provided to the rear end surfaces of all the actuator walls 203. The manifold 210 has a pair of opposite side walls 208 and 209 for defining therebetween an ink flow path 213. The wall 208 is attached to the rear end surfaces of all the actuator walls 203, and is formed with through-holes in fluid communication with the respective channels 205. The wall 208 separates all the dummy spaces 212 from the ink flow path 213, thereby preventing ink from entering the spaces 212. The manifold 210 serves to supply ink from an ink supply source (ink cartridge 25) to all the ink channels 205 of the print head 21. That is, the ink flow path 213 is in fluid communication with the ink cartridge 25. The electrodes 214, provided in the dummy channels (spaces) 212, are electrically grounded via an electrical wire 211. The electrodes 204, provided in the ink channels 205, are electrically connected to the head driver IC 58. The head driver IC 58 is for supplying actuator driving signals to the electrodes 204.

In the print head 21 having the above-described structure, the electrode 204 provided in each channel 205 can be supplied with a driving signal from the head driver IC 58. When the electrode 204 provided in one channel 205 is supplied with a driving signal of a voltage V [volts], two actuator walls 203, whose side surfaces are covered with the subject electrode 204, are deformed and are transversely displaced, thereby increasing the volume of the subject channel 205. This is because, when the driving voltage V [volts ] of positive polarity is applied to the electrode 204 in the subject channel 205 as shown in FIG. 6, two electric fields with opposite polarities F11 and F12 are generated through the two actuator walls 203 that sandwich the subject channel 205 therebetween. As a result, the two actuator walls 203 are deformed and are displaced in reverse directions to increase the volume of the subject channel 205. As a result, ink is introduced to the channel 205 from the ink flow path 213. When the driving voltage returns to zero (0) volts afterwardly, the two actuator walls 203 restore their original states shown in FIG. 5A, upon which ink in the channel 205 is applied with pressure and is ejected in the form of a droplet through the corresponding nozzle 206.

Although not shown in FIG. 4, the printing device 1 is further provided with an image scanner 38, as shown in FIG. 7, for reading image data from the original. The printing device 1 is further provided with: an image scanner motor (IS motor) 48 for driving a sheet feeding mechanism (not shown) to feed the original toward a position confronting the image scanner 38 and to expel the original from the image scanner confronting position. The printing device 1 is provided also with a communication modem 53 for demodulating facsimile data received from a telephone circuit 61 and for modulating image data read by the image scanner 38 to be transmitted through the telephone circuit 61.

A control system employed in the printing device 1 will be described below in greater detail with reference to FIG. 7.

The printing device 1 is provided with a CPU 40 and a gate array 42. The CPU 40 is for outputting a printing command to the print head unit 20 and for outputting a reading command to the image scanner 38. The CPU 40 controls the entire printing device 1 and performs a control operation shown in FIG. 10. The gate array 42 is for receiving image data transmitted from the host computer 60 via an interface 41 and developing the image data into print data D to be printed, and for receiving facsimile data demodulated by the modem 53 and developing the facsimile data into print data D to be printed. A ROM 43 and a RAM 44 are electrically connected between the CPU 40 and the gate array 42. The ROM 43 previously stores therein a program shown in FIG. 10 and other working programs to be executed by the CPU 40, data of telephone numbers of remote facsimile machines, and the like. The RAM 44 is for temporarily storing data received at the gate array 42. Data transfers among the CPU 40, the gate array 42, the ROM 43, and the RAM 44.

The gate array 42 is further connected with: an image memory 54 for temporarily storing the received and developed print data D (facsimile data and image data): and the encoder sensor 59 for outputting the detection signals 55 indicative of the position of the carriage 29.

The CPU 40 is electrically connected further to: a printing paper sensor 50 for detecting whether some printing paper P is mounted in the paper cassette (not shown); an original sensor 51 for detecting whether an original is set to a reading position to be read by the image scanner 38; a carriage origin sensor 52 for detecting whether or not the carriage 29 is at the home position; a first motor driver 45 for driving the carriage motor 14; a second motor driver 46 for driving a line feed motor 47 to rotate the platen roller 12; a third motor driver 49 for driving the image scanner motor 48 to feed the original; the operation panel 4 for supplying various signals to the CPU 40 in response to the operator's manipulation of the same; and a power source circuit 80 for applying an electric voltage V [volts] to the head driver IC 58.

The gate array 42 is designed to receive detection signals 55, which are produced by the encoder sensor 59, and a print timing signal 39, which is produced by the CPU 40. The frequency of the encoder sensor detection signals 55 is indicative of the moving speed of the carriage 29. The print timing signal 39 is indicative of a start timing of printing operation. The gate array 42 is designed to start producing print clock signals 57, transfer clock signals 56, and latch signals 62 in response to the print timing signal 39.

Figure 8:
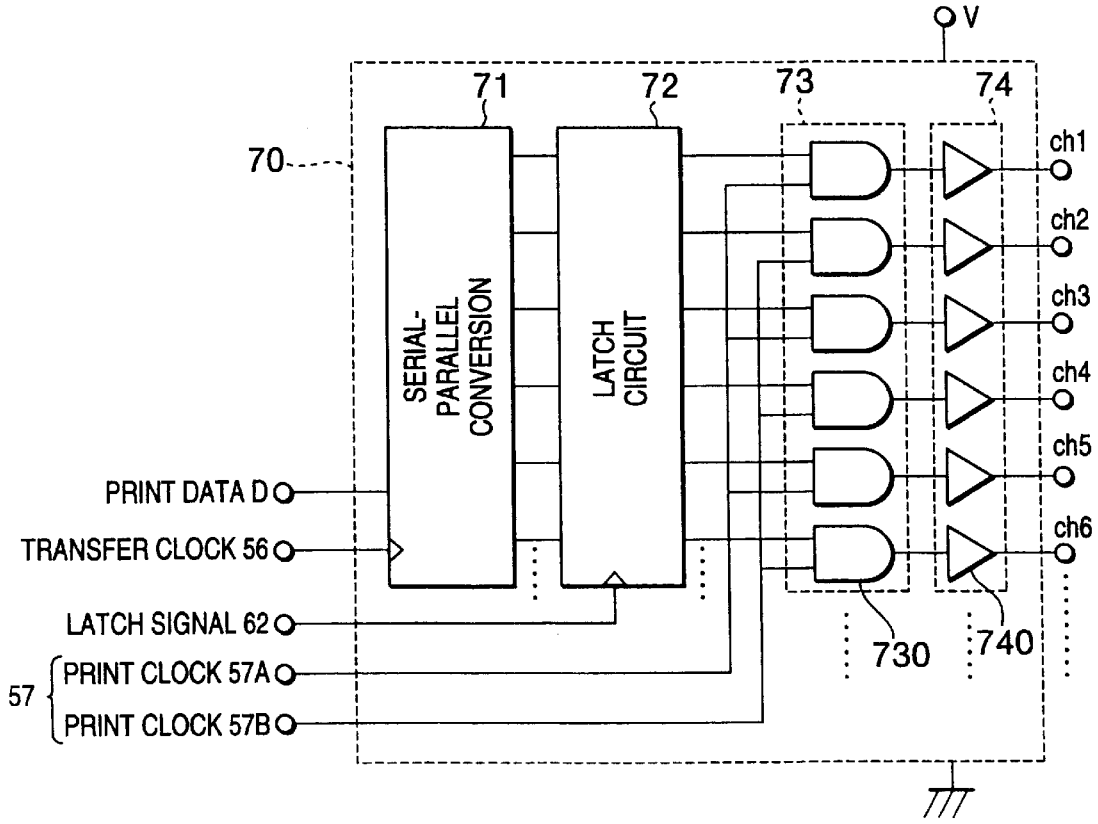
FIG. 8 is a circuit diagram showing a driving circuit for driving one print head.

The gate array 42 produces the print clock signals 57 based on the encoder detection signals 55. The gate array 42 produces the print clock signals 57 at timings synchronized with the encoder detection signals 55. The frequency f of the print clock signals 57 is therefore dependent on the frequency of the encoder detection signals 55. The print clock signals 57 are comprised of two sets of print clock signals 57A and 57B as shown in FIG. 8. For example, the gate array 42 repeatedly produces each of the print clock signals 57A and 57B at the frequency f, which is equal to the frequency, at which the gate array 42 receives the encoder detection signals 55.

In the present embodiment, during both the printer mode and the facsimile mode, the CPU 40 controls the first motor driver 45 to move the carriage 29 at such a speed that the gate array 42 will produce the print clock signals 57 at the frequency f of 10 KHz, for example. More specifically, the CPU 40 controls the first motor driver 45 to move the carriage 29 at a speed that the encoder sensor 59 will repeatedly produce the mark detection signals 55 at frequency of 10 KHz. Receiving the mark detection signals 55, the gate array 42 produces the print clock signals 57 at the same frequency of 10 KHz.

Figure 9A:
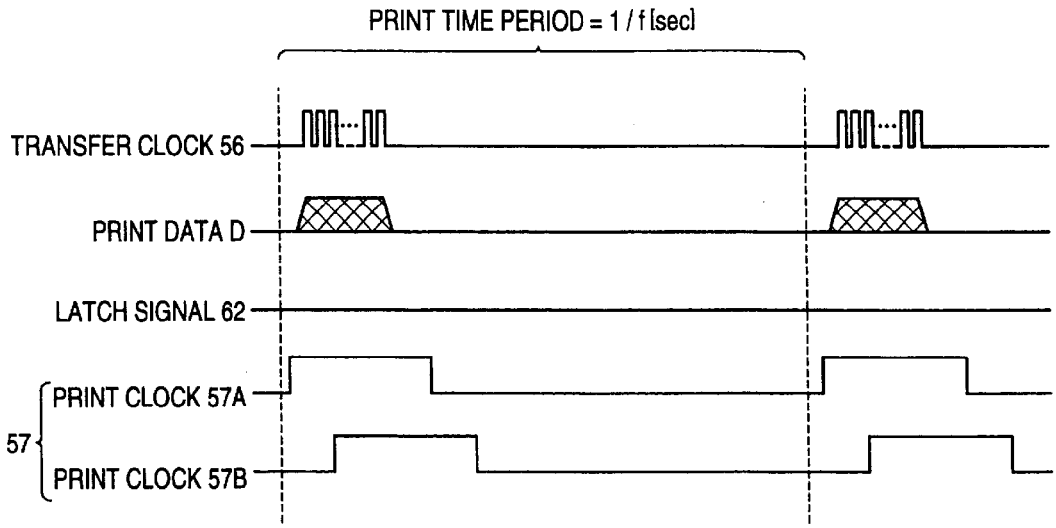
FIG. 9A is a timing chart of print data D and print clock signals 57A and 57B during the printer mode.

The gate array 42 repeatedly produces successive groups of transfer clock signals 56 at timings synchronized with the encoder detection signals 55. More specifically, the gate array 42 repeatedly produces the successive groups of transfer clock signals 56 at the same frequency f with the print clock signals 57. In each transfer clock signal group 56, 64 rising edges are successively produced as shown in FIG. 9A at a predetermined time interval. The start timing, at which each transfer clock signal group 56 is started, is determined based on a corresponding encoder detection signal 55. Accordingly, the successive groups of the transfer clock signals 56, each group being comprised of the 64 rising edges, are produced at the frequency f (10 KHz, in this example).

The gate array 42 repeatedly produces impulse-shaped latch signals 62 also in synchronization with the encoder detection signals 55. In this example, the latch signals 62 are produced also at the frequency f of 10 KHz.

The gate array 42 transfers the print data D from the image memory 54 to the head driver IC 58 in synchronization with the transfer clock signals 56.

The head driver IC 58 is for driving the print head unit 20 according to the print data D the transfer clock signals 56, the print clock signals 57, and the latch signals 62. More specifically, the head driver IC 58 is for receiving the print data D, the transfer clock signals 56, the print clock signals 57, and the latch signals 62, and for generating driving signals for driving the print heads 21–24.

The head driver IC 58 has four identical driving circuits 70 for respectively driving the four ink-jet print heads 21–24 of the print head unit 20. Each driving circuit 70 has a structure shown in FIG. 8.

That is, the driving circuit 70 includes: a serial-parallel converter 71; a latch circuit 72; an AND circuit 73; and an output circuit 74. The driving circuit 70 is for driving all the first through 64-th channels 205 (which will be referred to simply as ch1–ch 64 hereinafter) in the corresponding ink-jet print head. The AND circuit 73 is constructed from first through 64-th AND gates 730. The output circuit 74 (driver) is constructed from first through 64-th output gates 740. For example, the driver 74 is constructed from 64 bipolar transistors 740 arranged in a totem pole structure. The driver 74 is applied with an electric voltage of V [volts] from the power source circuit 80. It is noted that only the first though sixth channels ch1–ch6 are shown in FIG. 8.

The gate array 42 is designed to output a plurality of sets of print data D in serial form in synchronization with the successive rising edges in the transfer clock signals 56 shown in FIG. 9A. The serial print data D is inputted to the serial-parallel converter 71, where the serial print data D is converted into parallel print data. The parallel print date D is then latched by the latch circuit 72 at an input timing determined by a latch signal 62 supplied from the gate array 42. The print data, thus latched at the same time, includes 64 sets of print data D1–D64 to be printed by the first through 64-th channels ch1–ch64. The thus latched 64 sets of print data are outputted to the first through 64-th AND gates 730, respectively.

In this situation, the first print clock signal 57A is inputted at a first timing only to odd-numbered AND gates 730, that correspond to odd-numbered channels Ch1, Ch3, Ch5, . . . , and Ch63. As a result, only odd-numbered sets of print data D1, D3, . . . , and D63 are outputted from the odd-numbered AND gates 730 to odd-numbered output gates 740. The odd-numbered output gates 740 output driving signals, in accordance with the thus supplied odd-numbered sets of print data D1, D3, . . . , and D63, to electrodes 204 of the odd-numbered channels Ch1, Ch3, . . . , and Ch63. The driving signals, outputted from each of the odd-numbered output gates 740, has the voltage of V [volts] when the corresponding data Di (i=1, 3, . . . , or 63) indicates to print a dot. The driving signal has the voltage of zero (0) [volts] when the corresponding data Di (i=1, 3, . . . , or 63) indicates not to print a dot. In accordance with the thus supplied driving signals, ink droplets are selectively ejected from nozzles 206 communicated with the odd-numbered channels Ch1, Ch3, Ch5, . . . , and Ch63.

Then, at a second timing, the second print clock signal 57B is inputted only to even-numbered AND gates 730, that correspond to even-numbered channels Ch2, Ch4, Ch6, . . . , and Ch64. As a result, only even-numbered sets of print data D2, D4, . . . , and D64 are outputted from the even-numbered AND gates 730 to even-numbered output gates 740. The even-numbered output gates 740 output driving signals, in accordance with the thus supplied even-numbered sets of print data D2, D4, . . . , and D64, to electrodes 204 of the even-numbered channels Ch2, Ch4, . . . , and Ch64. The driving signal, outputted from each of the even-numbered output gates 740, has the voltage of V [volts] when the corresponding data Di (i=2, 4, . . . , or 64) indicates to print a dot. The driving signal has the voltage of zero (0) [volts] when the corresponding data Di (i=2, 4, . . . , or 64) indicates not to print a dot. In accordance with the thus supplied driving signals, ink droplets are selectively ejected from nozzles 206 communicated with the even-numbered channels Ch2, Ch4, Ch6, . . . , and Ch64.

As apparent from the above all the first through 64-th channels in each ink-jet print head are divided into two groups, and the two groups of channels are driven at the first and second different timings. If all the channels were driven simultaneously, the print head will require a too large amount of electric power, and the temperature of the head driver IC 58 will likely be increased too much.

It is noted that a series of print data groups is supplied in succession to the serial-parallel converter 71 in synchronization with the transfer clock signals 56. From the serial-parallel converter 71, a plurality of print data groups, each group being comprised of 64 sets of print data D1–D64, are outputted in succession to the latch circuit 72 and latched therein at the frequency f. The print clock signal 57A is repeatedly supplied to the AND circuit 73 at the frequency f. The print clock signal 57B is repeatedly supplied to the AND circuit 73 also at the frequency f. Thus, the plurality of print data groups are supplied successively to the print head at the frequency f.

According to the present embodiment, the waveform of each of the print clock signals 57A and 57B is changed according to the mode set for the printing device 1. More specifically, when the printing device 1 is set to the printer mode, the gate array 42 produces each of the print clock signals 57A and 57B in the waveform of a single pulse as shown in FIG. 9A. That is, while each print data group, comprised of the first through 64-th sets of print data D1–D64, is latched by the latch circuit 72, a single pulse of the print clock signal 57A and a single pulse of the print clock signal 57B are successively inputted to the AND circuit 73.

With this control, each odd-numbered channel Chi (i=1, 3, . . . , 63) is applied with a driving signal, which has a shape of a single pulse in the print clock 57A and which has a voltage 0 or V [volts] in accordance with the corresponding set of print data Di (i=1, 3, . . . , 63). Accordingly, each odd-numbered channel Chi will eject a single ink droplet when the applied driving signal has the voltage of V [volts], and will not eject any ink droplet when the applied driving signal has the voltage of zero [volts]. Similarly, each even-numbered channel Chi (i=2, 4, . . . , 64) is applied with a driving signal, which has a shape of a single pulse in the print clock 57B and which has a voltage 0 or V [volts] in accordance with the corresponding set of print data Di (i=2, 4, . . . , 64). Accordingly, each even-numbered channel Chi will eject a single ink droplet when the applied driving signal has the voltage of V [volts] and will not eject any ink droplet when the applied driving signal has the voltage of zero [volts].

Figure 9B:
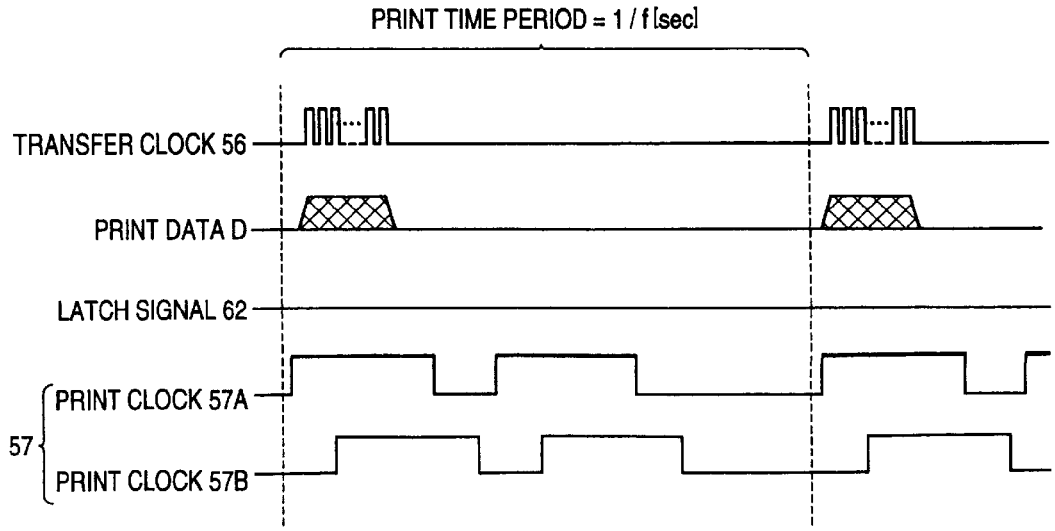
FIG. 9B is a timing chart of print data D and print clock signals 57A and 57B during the facsimile mode.

When the printing device 1 is set to the facsimile mode, on the other hand, the gate array 42 produces each of the print clock signals 57A and 57B in the waveform of a multi-pulse as shown in FIG. 9B. That is, while each print data group, comprised of the first through 64-th sets of print data D1–D64, is latched by the latch circuit 72, two successive pulses of the print clock signal 57A and two successive pulses of the print clock signal 57B are inputted to the AND circuit 73 as shown in FIG. 9B.

With this control, each odd-numbered channel Chi (i=1, 3, . . . , 63) is applied with the driving signal, which has a shape of two successive pulses in the print clock 57A and which has a voltage 0 or V [volts] in accordance with the corresponding set of print data Di (i=1, 3, . . . , 63). Accordingly, each odd-numbered channel Chi will eject ink droplets two times in succession when the applied driving signal has the voltage of V [volts], and will not eject any ink droplet when the applied driving signal has the voltage of zero [volts]. Similarly, each even-numbered channel Chi (i=2, 4, . . . , 64) is applied with a driving signal, which has a shape of two successive pulses in the print clock 57B and which has a voltage 0 or V [volts] in accordance with the corresponding set of print data Di (i=2, 4, . . . , 64). Accordingly, each even-numbered channel Chi will eject ink droplets two times in succession when the applied driving signal has the voltage of V [volts], and will not eject any ink droplet when the applied driving signal has the voltage of zero [volts].

It is noted that only the black color print head 21 is driven at the timing of FIG. 9B during the facsimile mode because monochromatic facsimile data D is received from remote communication machines. On the other hand, all the four print heads 21–24 can be driven during the printer mode. That is, all the print heads 21–24 are driven at the timing of FIG. 9A when full color image data D is received from the host computer. Only the black color print head 21 is driven at the timing of FIG. 9A when monochromatic image data D is received from the host computer.

Thus, during the facsimile mode, in order to reproduce a black dot represented by one set of print data, a corresponding channel in the print head 21 is actuated twice. Accordingly, each dot, represented by a single set of print data, will be reproduced by two ink droplets of the same black color. Accordingly, a two droplet-combined dot will be created to reproduce the single set of print data. Though this two droplet-combined dot is formed by the same color ink, this dot has the same size as the dot 200 shown in FIG. 1B which is formed by two droplets of different colors.

Figure 1B:
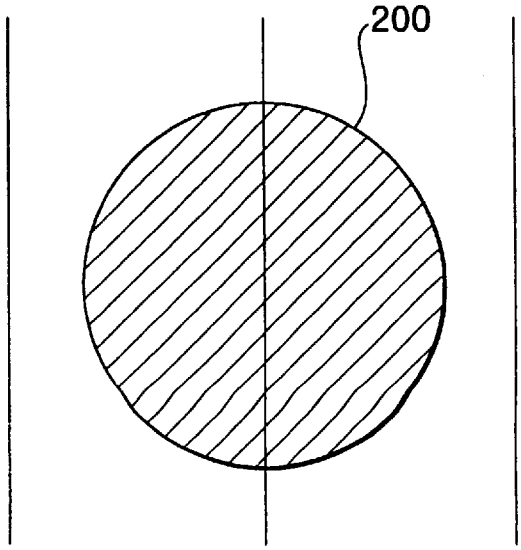
FIG. 1B illustrates another single ink dot formed on a print paper, the ink dot being made from two ink droplets of two colors ejected from nozzles according to one dot's worth of print data.

During the printer mode, on the other hand, when one set of print data represents a dot of black, cyan, magenta, or yellow, a corresponding channel in a corresponding print head is actuated only once. Accordingly, a dot will be reproduced by only one ink droplet of the corresponding color. A single droplet-forming dot 100 as shown in FIG. 1A will be created to reproduce the subject set of print data. When another set of print data represents a dot of color other than the above-described four colors, on the other hand, a corresponding channel in each of two corresponding print heads 21 is actuated once. Accordingly, a dot will be reproduced by two ink droplets of different colors. A two droplet-combined dot 200 shown in FIG. 1B is created to reproduce the subject set to print data.

Figure 10:
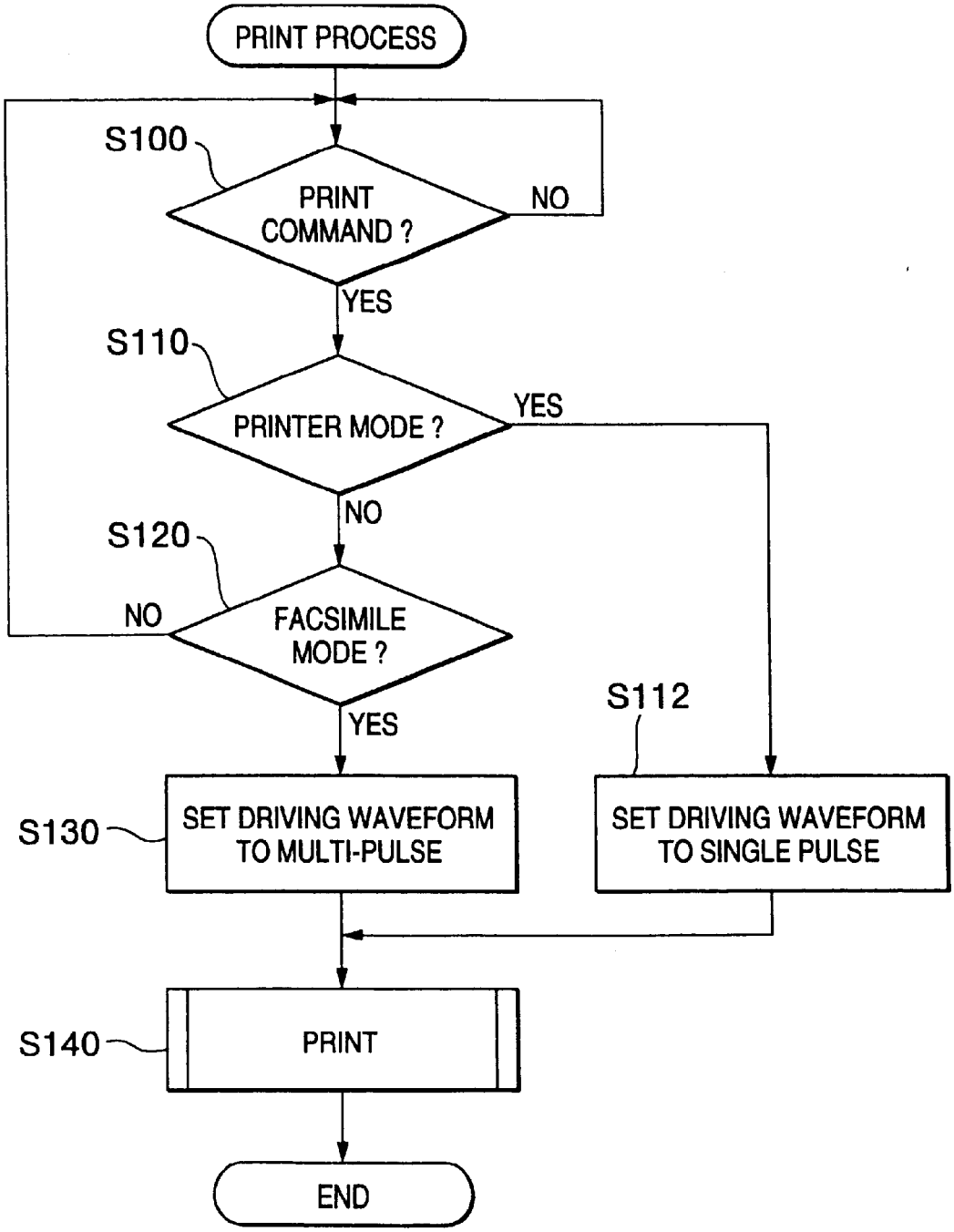
FIG. 10 is a flowchart showing a control performed by the first embodiment.

The above-described switching control is performed by the CPU 40 as shown in FIG. 10.

When a print command is instructed from a user of the printing device 1 or is received from facsimile signals transmitted from a remote facsimile machine in S100 ("Yes" in S100), it is judged in S100 whether or not the printer 1 is presently set to the printer mode. That is, it is judged whether or not the switch key 6*a* has been manipulated into the printer mode position. When the present mode is not set to the printer mode (no in S110), it is further judged in S120 whether or not the printer 1 is presently set to the facsimile mode. That is, it is judged whether or not the switch key 6*a* has been manipulated into the facsimile mode position.

When the present mode is the facsimile mode (yes in S120), the CPU 40 controls in S130 the gate array 42 to produce each of the print clock signals 57A and 57B in a multi-pulse waveform as shown in FIG. 9B. That is, one set of print clock signal 57A, for printing odd-numbered sets of print data D1, D3, . . . , and D63, is formed as comprised of two successive pulses. Similarly, one set of print clock signal 57B, for printing even-numbered sets of print data D2, D4, . . . , and D64, is formed as comprised of two successive pulses.

In S140, the black color print head 21 is driven by driving signals, which have the waveform of the pulses 57A and 57B of FIG. 9B and which have voltages of zero (0) or V [volts] in correspondence with the first through 64-th sets of print data D1–D64. Accordingly, each of the channels Ch1–Ch64, that should eject ink according to the print data D1–D64, ejects ink droplets two times onto a corresponding location on the print paper.

Thus, during the facsimile mode, the channels 205 in the black color print head 21 are actuated twice in order to print the respective dots. Ink droplets are ejected twice from each of the nozzles that should eject ink to reproduce the print data. Accordingly, two ink droplet, ejected from one nozzle, are attached on the print paper P at the same location to form a single dot 200 of FIG. 1B.

Figure 2:
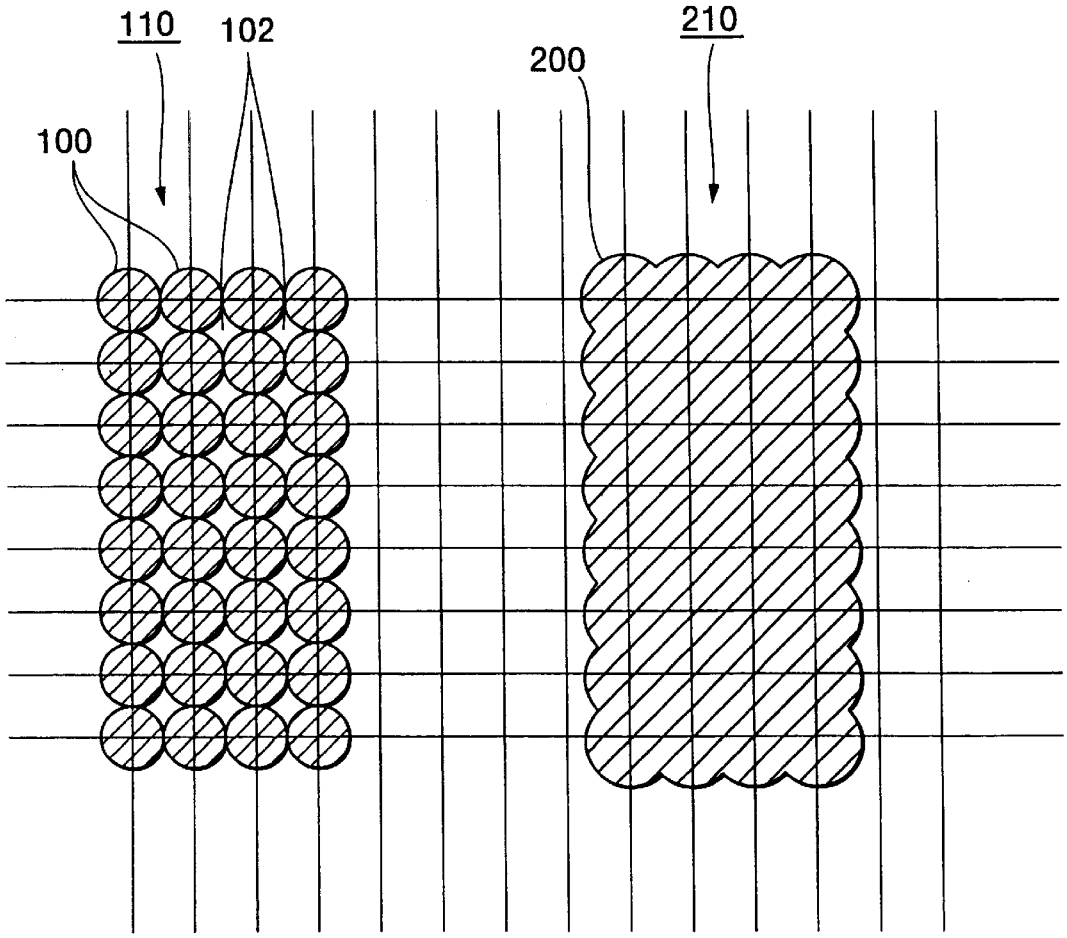
FIG. 2 shows a solid image produced by a plurality of dots of FIG. 1A and another solid image produced by a plurality of dots of FIG. 1B.

The thus created two droplet-combined dot 200 has a size larger than that of a dot 100 shown in FIG. 1A as created by a single droplet ejected by a single ejection operation. Accordingly, when desiring to print a solid black image during the facsimile mode, the solid image 210 as shown in FIG. 2 can be obtained. In the solid image 210, no spaces will be formed among respective dots 200. Accordingly, the print density of the black solid image 210 becomes higher than that of the black solid image 110 obtained by the conceivable printer. The print density of the black solid image 210 becomes higher than that of a black solid image obtained during the printer mode as will be described below. The print density of the black solid image 210 is approximately the same as that of a full color solid image obtained during the printer mode.

That is, when the present mode is the printer mode (yes in S110), the CPU 40 controls in S112 the gate array 42 to produce each of the print clock signals 57A and 57B in a single pulse waveform as shown in FIG. 9A. That is, one set of print clock signal 57A, for printing odd-numbered sets of print data D1, D3, . . . and D63, is formed as comprised of only a single pulse. Similarly, one set of print clock signal 57B, for printing even-numbered sets of print data D2, D4, . . . , and D64 is formed as comprised of a single pulse.

In S140, the print head unit 20 is driven by driving signals, which have the waveform of the pulses 57A and 57B of FIG. 9A and which have voltages of zero (0) or V [volts] in correspondence with the first through 64-th sets of print data D1–D64. More specifically, when the image data D received from the host computer is for a monochromatic image, only the black color print head 21 is driven by the driving signals. Each of the channels Ch1–Ch64 in the print head 21, that should eject ink according to the print data D1–D64, ejects an ink droplet only once onto a corresponding location on the print paper. Accordingly, a monochromatic image will be produced form a plurality of single droplet-forming dots 100 of FIG. 1A. Especially when the received print data D represents a solid black image, a solid black image 110 will be produced as shown in FIG. 2 as formed with spaces 102. The solid black image 110 will therefore present a print density lower than the solid black image 210 obtained during the facsimile mode.

When the image data D received from the host computer represents a full color image, on the other hand, in order to reproduce a set of print data indicative of black cyan, magenta, or yellow, a corresponding channel in a corresponding print head ejects an ink droplet only once onto a corresponding location on the print paper. In order to reproduce another set of print data indicative of color other than black, cyan, magenta, or yellow, a corresponding channel in each of two corresponding print heads ejects an ink droplet only once onto a corresponding location on the print paper. Accordingly, a full color image will be produced from mixture of the single droplet-forming dots 100 of FIG. 1A and the two droplet-combined dots 200 of FIG. 1B. Thus, the obtained full color image will entirely appear thick, and will have approximately the same print density as the black image obtained during the facsimile mode. Especially when the received print data D is indicative of a full color solid image, a full color solid image 210 as shown in FIG. 2 is produced as formed with almost no spaces among respective dots, and therefore presents a print density approximately the same as that of the solid black image 210 obtained during the facsimile mode.

As described above, according to the printing device of the first embodiment, when the printing instruction is issued in S100, it is judged in S100 whether or not the present mode is the printer mode. When the present mode is not set to the printer mode, it is further judged in S120 whether or not the present mode is set to the facsimile mode. When the present mode is set to the facsimile mode, the waveform of the print head driving signal (print clock signal 57) is set in S130 into a multi-pulse waveform, comprised of two successive pulses, to print every single set of print data. In S140, printing operation is performed with the multi-pulse driving signal. Accordingly, ink droplets are ejected twice from a single nozzle to print a corresponding single set of print data. Thus, when printing facsimile data, the number of times the print clock signals is generated is increased twice, thereby increasing the print density. The processes of S110 and S120 serve to judge whether the printing device 1 is in the facsimile mode or the printer mode, and the processes of S130 and S112 serve to change printing density of an image to be printed.

A second embodiment of the printing device will be described below with reference to FIG. 11.

As described already, each of the print heads 21–24 is of a type that changes pressure in the channels 205 based on piezoelectric shear-mode deformation developed by electric voltages applied to the piezoelectric ceramics walls 203. The changes in pressure result in ejecting ink droplets through nozzles 206 communicated with the channels 205. The amount of changes in the pressure can be increased when the amount of voltages applied to the piezoelectric ceramics walls 203 is increased. Accordingly, it is possible to increase the ink amount of each ink droplet and to increase the printing density through merely changing the amount of the driving voltage V [volts] applied to the print head.

Figure 11:
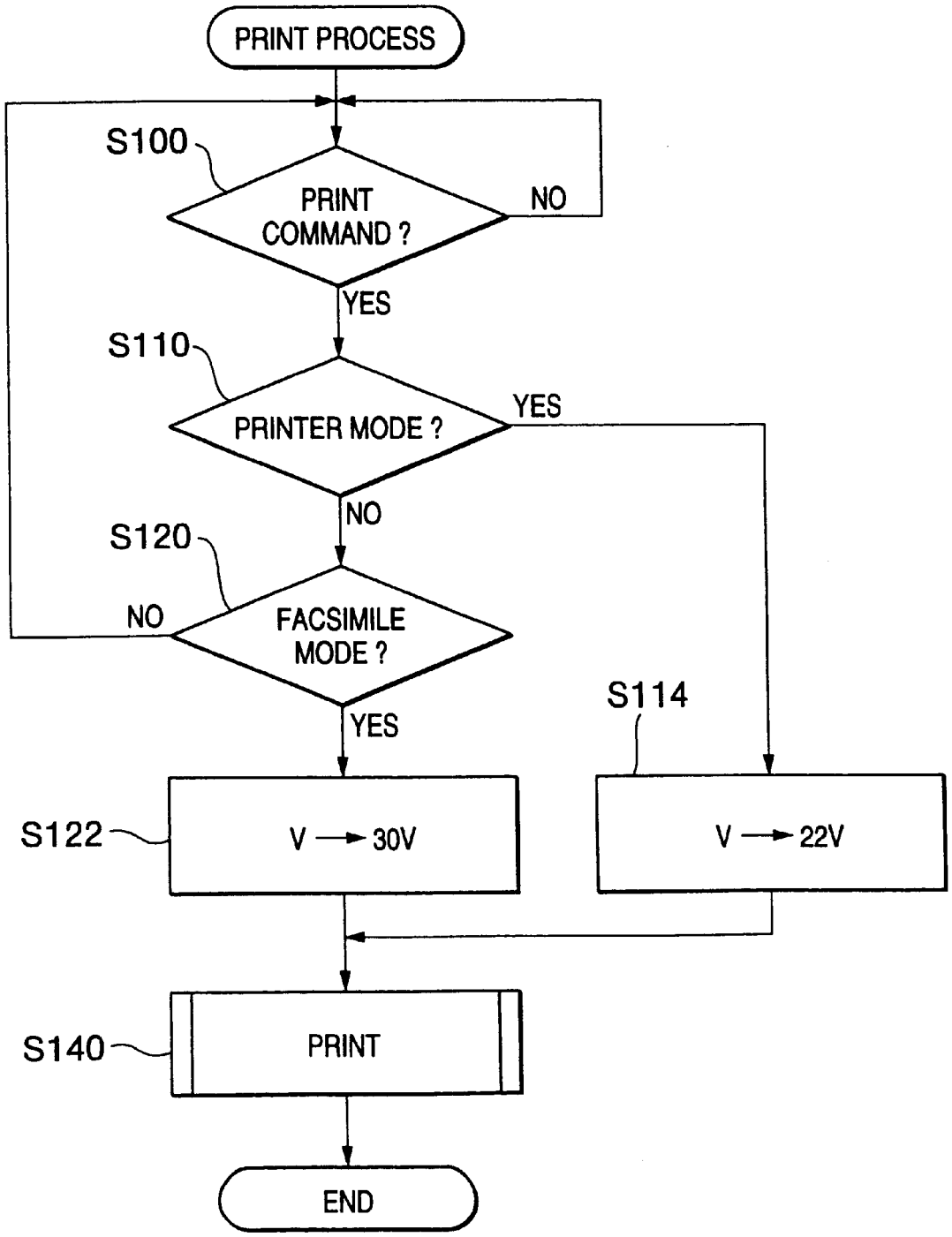
FIG. 11 is a flowchart showing a control performed by second embodiment.

According to the present embodiment, therefore, the CPU 40 performs a control operation shown in FIG. 11 to increase the amount of the voltage applied to the piezoelectric ceramics wall 203 during the facsimile mode. In the present embodiment, each of the print clock pulses 57A and 57B is maintained in the single pulse waveform as shown in FIG. 9A both in the printer mode and in the facsimile mode. The voltage of the driving signal is increased in the facsimile mode. More specifically, the CPU 40 controls the power source circuit 80 to change the amount of the voltage V [volts] outputted to the output circuits (drivers) 74 of the driving circuits 780. The CPU 40 controls the power source circuit 80 to output the voltage V [volts] so that the voltage V will have a larger amount during the facsimile mode than during the printer mode.

The control will be described below with reference to FIG. 11.

When the print instruction is received in S100 and it is judged that the present mode is the facsimile mode (no in S110 and yes in S120), the amount of the driving voltage applied to the output circuit 74, that is connected to the black color head 21, is set to 30 volts in S122. That is, the CPU 40 controls the power source circuit 80 to supply 30 [volts] to the output circuit 74 for the black color head 21. Then, the black color head 21 is driven with the driving voltage of 30 volts in S140, thereby performing a black color printing. When the present mode is judged as printer mode (Yes in S110), on the other hand, the driving voltage V [volts] is set to 22 volts in S114. That is, the CPU 40 controls the power source circuit 80 to supply 22 [volts] to the output circuit 74 for the black color head 21 when producing a monochromatic image. The CPU 40 controls the power source circuit 80 to supply 22 [volts] to the output circuits 74 for all the print heads 21–24 when producing a full color image.

With this control, the black color head 21 is driven during the facsimile mode at voltages higher than those applied during the printer mode. The amount of ink in each ink droplet ejected from a single nozzle through a single driving operation will be increased during the facsimile mode in comparison with the printer mode. It is therefore possible to increase the printing density of an image obtained during he facsimile mode.

Thus, according to the second embodiment, the amount of the voltage applied to the black color head 21 is increased, thereby increasing the printing density. It is noted that the processes of S122 and S114 serves to change printing density.

As described above, according to the first and second embodiments, it becomes possible to print images of the certain color (black color in the above-described example) through monochromatic printing operation so that the obtained monochromatic image will present a print density higher than that of a monochromatic image obtained during full color printing operation.

However, the above-described control methods of the first and second embodiments can be used to merely print images with a print density higher than a desired certain value. That is, when desiring to print images at a print density higher than a certain value, the number of pulses constituting the driving pulse signals (print clock pulses 57) may be set higher than that of pulses constituting the driving pulse signals (print clock pulses 57) to be supplied to print images at the certain print density or less. Or, the amount of voltages in the driving pulse signals may be set higher than that of the driving pulse signals to be supplied to print images at the certain print density or less.

A third embodiment of the present invention will be described below with reference to FIGS. 12A–14.

In the first embodiment, the number of the print clock pulses (driving pulses) used for printing each set of facsimile data is set higher than the number of the print clock pulses (driving pulses) for printing each set of image data transmitted from the host computer. With this control method, the amount of ink for forming each of dots constituting a facsimile image becomes larger than that of ink for forming each of dots constituting a host computer-supplied print image. The print density of the facsimile image becomes higher than that of the print image when the print image is printed with a single color.

When the number of pulses to be supplied to the print head is increased for each set of print data, the number of times that the driving circuit is driven is increased. As a result, the head driver IC 58 will possibly generate heat of a larger amount. The lifetime of the head driver IC 58 may possibly decrease. It is conceivable to increase the heat releasing efficiency of the head driver IC 58 through providing the head driver IC 58 with a heat sink, a cooling fan, or the like.

The present embodiment provides another method for preventing the head driver IC 58 from generating heat. According to the present embodiment, the frequency f of the print clock signals 57 is controlled so that the frequency f during the facsimile mode will become lower than the frequency f during the printer mode. More specifically, the CPU 40 controls the first motor driver 45 to control the carriage 29 to move at a lower speed during the facsimile mode than during the printer mode. As a result, the frequency f, at which the encoder sensor 59 outputs the detection signals 55 during the facsimile mode, becomes lower than the frequency f, at which the encoder sensor 59 outputs the detection signals 55 during the printer mode. The gate array 42 produces the print clock signals 57, the transfer clock signal groups 56, and the latch signals 62 in synchronization with the detection signals 55. Accordingly, the frequency f, at which the gate array 42 outputs the print clock signals 57, the transfer clock signal groups 56, and the latch signals 62 during the facsimile mode, becomes lower than the frequency f, at which the gate array 42 outputs them during the printer mode.

Figure 12A:
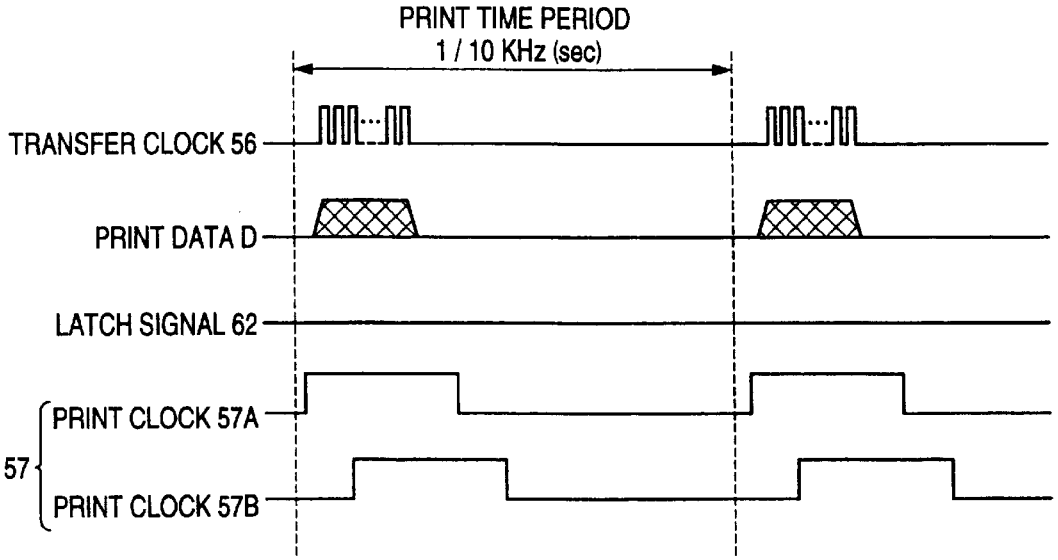
FIG. 12A is a timing chart of print data D and print clock signals 57A and 57B during the printer mode according to a third embodiment.
Figure 12B:
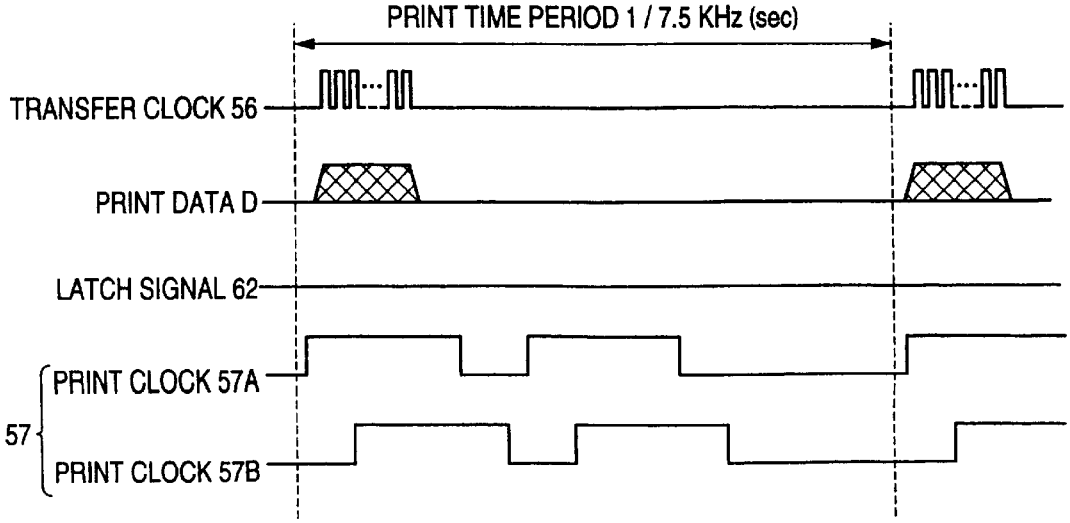
FIG. 12B is a timing chart of print data D and print clock signals 57A and 57B during the facsimile mode according to the third embodiment.

At the thus controlled frequency f, the plurality of groups of print data, each group being comprised of 64 sets of print data D, are successively supplied to the latch circuit 72 and latched thereby. During the printer mode, the print clock signals 57A and 57B, each in the single pulse waveform, are supplied to the AND circuit 73 at the controlled frequency f. During the facsimile mode, the print clock signals 57A and 57B, each in the multi-pulse waveform, are supplied to the AND circuit 73 at the controlled frequency f. In this example, the frequency f is controlled to 10 KHz during the printer mode as shown in FIG. 12A, and is controlled to 7.5 KHz during the facsimile mode as shown in FIG. 12B.

Control performed by the CPU 40 according to the present embodiment will be described below with reference to FIG. 13.

The control performed by the present embodiment is the same as that of the first embodiment shown in FIG. 10 except that a frequency setting process of S135 is added between processes S130 and S140 and that another frequency setting process of S114 is added between processes S112 and S140.

That is, during the facsimile mode (no in S110 and yes in S120), after the CPU 40 controls the gate array 42 to produce each of the print clock signals 57A and 57B into the multi-pulse waveform in S130, the CPU 40 further controls the moving speed of the carriage 29 so that the frequency f of the print clock signals 57A and 57B will become 7.5 KHz in S135. In S140, channels in the black color head 21 are driven by driving signals in the form of the multi-pulse clock signals 57A and 57B at frequency of 7.5 KHz as shown in FIG. 12B. Thus, black color printing is performed onto the print paper with the multi-pulse driving signals at frequency of 7.5 KHz.

during the printer mode (yes in S110), on the other hand, the CPU 40 controls the gate array 42 to produce each of the print clock signals 57A and 57B into the single pulse waveform in S112, and then controls the moving speed of the carriage 29 so that the frequency f of the print clock signals 57A and 57B will become 10.0 KHz in S114. Print data received from the host computer 60 is then printed in S140 with driving signals in the form of the single pulse waveform at the frequency of 10.0 KHz as shown in FIG. 12A.

Thus, according to the present embodiment, it is possible to control the driving frequency for printing facsimile data to be lower than the driving frequency for printing host computer-supplied image data. It is therefore possible to suppress heat generation in the head driver IC 58 even when the head driver IC 58 is driven with the multi-pulse clock signals 57A and 57B of FIG. 12B. It is possible to lengthen the life of the head driver IC 58. It is unnecessary to provide any additional members such as a heat sink or a cooling fan to the head driver IC 58 in order to enhance heat releasing efficiency of the head driver IC 58. The printing device 1 can be produced at a low cost.

As described above, according to the present embodiment, during the facsimile mode, the driving waveform of each driving signal 57A and 57B is set in S130 into a multi-pulse signal comprised of two successive pulses in correspondence with every single set of print data. Then, in S135, the driving frequency is set to 7.5 KHz, and printing operation is performed with the multi-pulse driving signals in S140. It therefore becomes possible to suppress heat generation in the head driver IC 58. The processes of S135 and S114 serve to control frequency of the driving signals.

Figure 14:
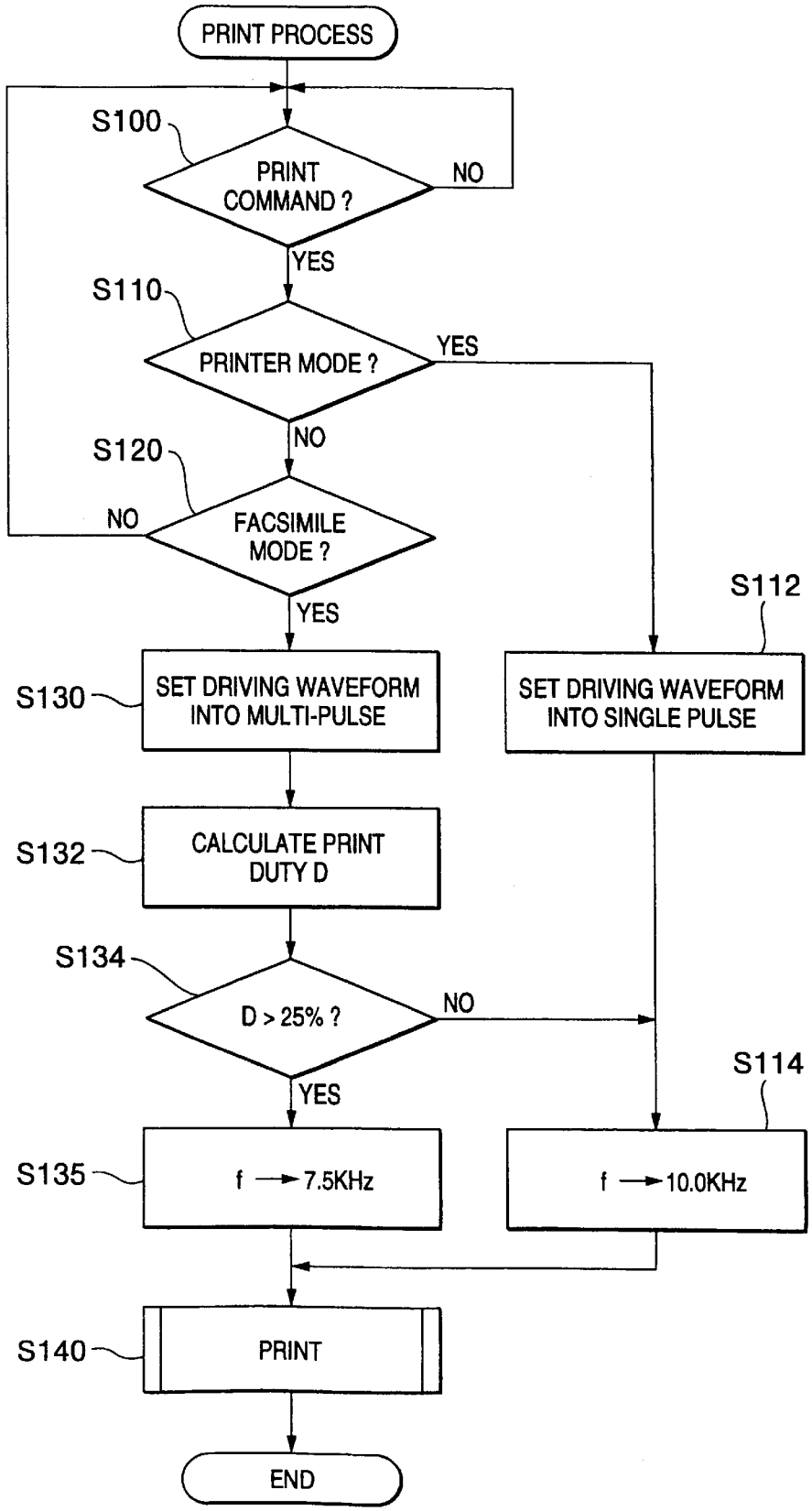
FIG. 14 is a flowchart showing a control performed by a fourth embodiment.

A fourth embodiment will be described below with reference to FIG. 14.

According to the control performed by the third embodiment, the head driver IC 58 consumes electric power in response to the print clock signals 57A and 57B. The average power W consumed by th head driver IC 58 for each ink-jet print head is calculated by the following formula (1)

$$W=n(CE^2fDm)/100 \text{ [watt]} \quad (1)$$

where n is the number of pulses constituting the waveform of each of the print clock signals 57A and 57B, f is the driving frequency [Hz] of the print clock signals 57A and 57B, C is capacitance [pF] of the piezoelectric ceramics forming each print head, E is an amount of the driving voltage (V) applied to each print head, m is the number of channels provided in each print head, and D is a printing duty [%].

It is assumed that in this example, C is equal to 2,000 [pF], E is 30 [volts], and m is 64. The printing duty D is defined as a ratio of an area, to be printed with ink on a print paper P, with respect to a predetermined printing area on the print paper. In other words, the printing duty D is defined as a ratio of the number of dots, to be actually printed within the printing area of the print paper P, with respect to the total number of dots constituting the entire printing area.

A relationship between the driving frequency f of the print clock signals 57A and 57B and the average power W consumed by the head driver IC 58 is shown in Table 1 below.

TABLE 1

| | Print mode | Ink droplet amount | Driving signal frequency f | Number "n" of driving waveform pulses | Consuming power average [watt] |
|---|---|---|---|---|---|
| Third embodiment | printer | 40 pl | 10.0 KHz | Single pulse 1 | 0.576 [watt] |
| | facsimile | 60 pl | 7.5 KHz | Multi-pulse 2 | 0.864 [watt] |
| Comparative example (First Embodiment) | facsimile | 60 pl | 10.0 KHz | Multi-pulse 2 | 1.152 [watt] |

During the printer mode, the driving frequency f is adjusted to 10 KHz, the number of pulses constituting each set of print clock signals 57A and 47B is set to one (1). Accordingly, when print data with the printing duty D of 50 [%] is received, the head driver IC 58 will consume electric power with a power average W of 0.576 [watt]. This value W is calculated through substituting the above-cited values into the formula (1). The calculated result is shown in Table 1.

During the facsimile mode, on the other hand, the driving frequency f is adjusted to 7.5 KHz, and the number of pulses constituting the waveform of each print clock signal is set to two (2). When facsimile data with the printing duty D of 50 [%] is received, the head driver IC 58 will consume electric power with a power average W of 0.864 [watt]. This value W is calculated also through substituting the above-cited values into the formula (1). The calculated result is shown also in Table 1. It is noted that when the driving frequency f is maintained unchanged as 10 KHz during the facsimile mode as in the first embodiment, the head driver IC 58 will consume electric power with its power average W of 1.152 [watt].

It is noted that when the head driver IC 58 consumes electric power with a large power average, the head driver IC 58 generates a great amount of heat. If the head driver IC 58 generates too much amount of heat, the head driver IC 58 will have to be provided with some heat releasing structure such as a heat sink or a cooling fan.

During the facsimile mode, according to the third embodiment, when receiving print data with printing duty D of higher than 50 [%], the power average W consumed by the head driver IC 58 will exceed 0.864 [watt]. The power average will therefore become near to 1 [watt]. The power average will possibly exceed 1 [watt].

Print data with the printing duty D of 50 [%] represents a print image, which has a solid image portion in a half of the entire area of he print paper P. It is rare, however, for the printing device to receive print data with printing duty D of 50 [%] or more. Generally, the printing device 1 will receive print data with printing duty D of much less than 50 [%]. Especially, facsimile data is mainly comprised of text data, and therefore has a large amount of non-printing portions among respective characters and among respective character lines. Accordingly, facsimile data has generally print duty D of much less than 50 [%].

In view of this, according to the present embodiment, print data (facsimile data) with printing duty D of higher than 25 [%] is defined as a certain type of print data that has a large amount of print area to be printed. During the facsimile mode, only when receiving the certain type of print data with printing duty D of higher than 25 [%], the driving frequency f of the print clock signals 57A and 57B is decreased to 7.5 [KHz], thereby decreasing the average consuming power W of the head driver IC 58. Thus, the driving frequency f is adjusted to the low frequency of 7.5 KHz during the facsimile mode only when the printing amount of the received facsimile exceeds the predetermined amount. The present embodiment can therefore maintain high printing speed even during the facsimile mode while effectively suppressing heat generation by the head driver IC 58.

Control performed by the CPU 40 in the present embodiment will be described below with reference to FIG. 14.

Figure 13:
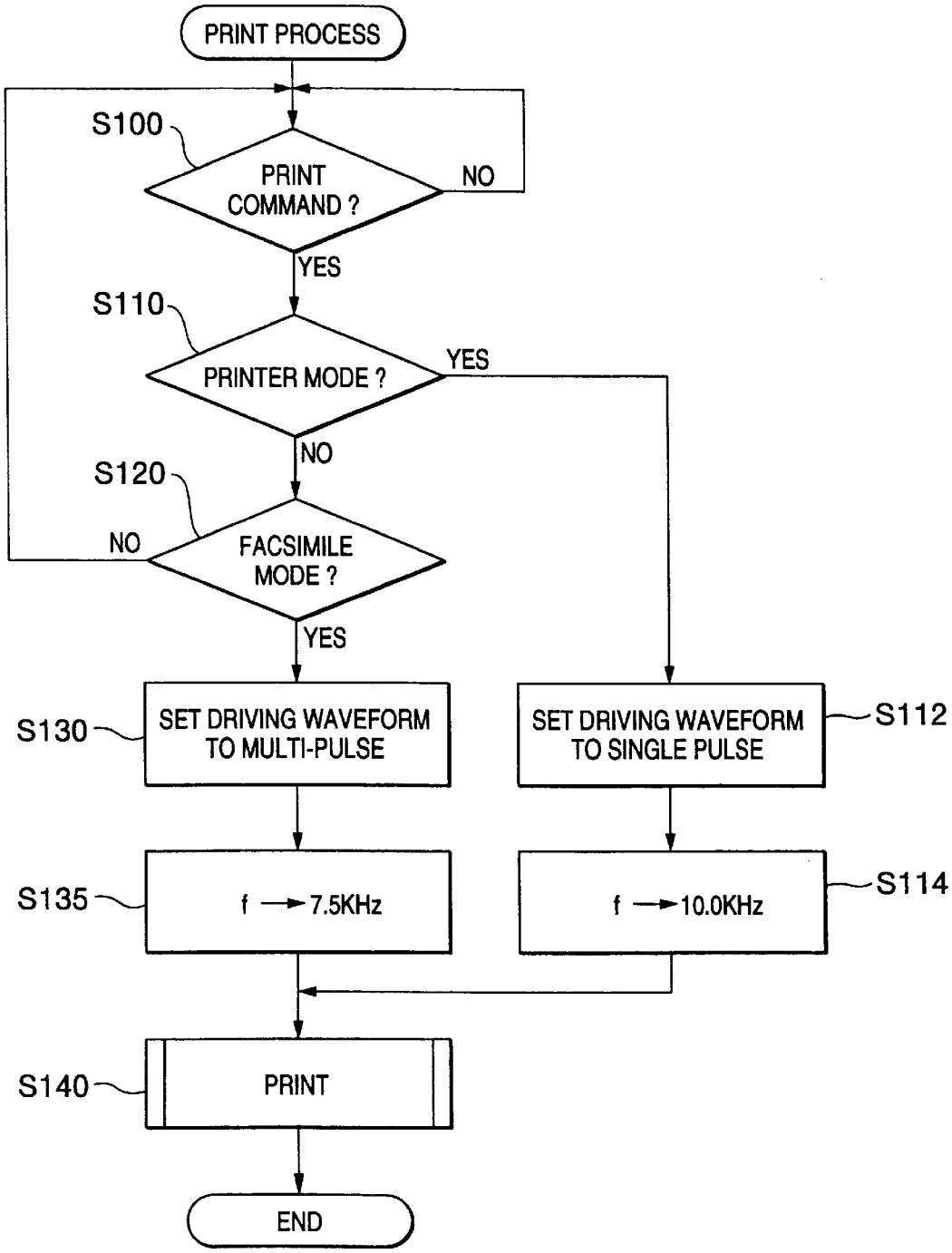
FIG. 13 is a flowchart showing a control performed by the third embodiment.

The control in the present embodiment is the same as that of the third embodiment shown in FIG. 13 except that processes S132 and S134 are additionally provided.

That is, during the facsimile mode (no in S110 and yes in S120), after the waveform of the print clock signals 57A and 57B is set into multi-pulse waveform in S130, printing duty D is calculated in S132 based on facsimile data presently stored in the image memory 43. The printing duty D corresponds to the amount of ink to be printed on a print paper to reproduce the facsimile data. When the calculated printing duty D exceeds 25 [%] (yes in S134), the driving frequency f is adjusted to 7.5 KHz in S135. That is, the moving speed of the carriage 29 is adjusted so that the frequency f will become 7.5 KHz. Then, in S140, the black ink print head 21 is driven by the facsimile data with the print clock signals 57A and 57B of the driving frequency f in 7.5 KHz as shown in FIG. 12B, thereby printing the facsimile data on the print paper P.

During the printer mode (yes in S110), on the other hand, after the waveform of the print clock signals 57A and 57B is set to a single pulse waveform in S112, the driving frequency f is adjusted to 10.0 KHz in S114 in the same manner as in the third embodiment. Accordingly, printing operation is performed with high speed as shown in FIG. 12A.

Similarly, even during the facsimile mode, when the printing duty D for the received facsimile data is calculated as equal to or lower than 25 [%] (no in S134), the driving frequency f of the print clock pulse signals 57A and 57B is adjusted to 10.0 KHz in S114. This is because in this case, the head driver IC 58 will not be supplied with a large amount of load, and therefore will not generate a much amount of heat. Accordingly, it is possible to perform high speed printing operation even during the facsimile mode.

Thus, according to the fourth embodiment, only when desiring to print facsimile images with printing duty D of more than 25 [%], the driving frequency is set lowered. It is therefore possible to sufficiently suppress heat generation in the head driver IC 58. It is unnecessary to provide the head driver IC 58 with the heat releasing structure.

The above-described control methods of the third and fourth embodiments can be used to print images with a print density higher than a desired certain value. That is, when desiring to print images at a print density higher than the predetermined value, the number of pulses constituting the driving pulse signals (print clock pulses) may be set higher than that of pulses constituting the driving pulse signals (print clock pulses) to print images at the certain print density or less. During this control, the frequency of the driving pulse signals is controlled to sufficiently suppress heat generation in the driving circuit when printing images at the print density higher than the predetermined density.

It is noted that the process of S132 serves to detect a ratio of a printing amount with respect to the predetermined printing area in a printing paper.

While the invention has been described in detail with reference to the specific embodiments thereof, it would be apparent to those skilled in the art that various changes and modifications may be made therein without departing from the spirit of the invention.

For example, in the printing device 1 of the above-described embodiments, the operator manipulates the switch 6*a* to switch between the printer mode and the facsimile mode. However, the switching operation between the printer mode and the facsimile mode may not be performed manually, but may be performed automatically through judging the kind of an information path, along which print data has been inputted to the printing device 1.

The judging processes of S110 and S120 may be designed to judge whether or not the received print data is for monochromatic printing or full color printing. More specifically, the process of S110 may be designed to judge whether the received image data is to be printed with a plurality of colors. The process of S120 may be designed to judge whether the received print data is to be printed with a single color. With this control, print data to be printed with a single color will be printed with multi-pulse driving signals 57A and 57B of FIG. 9B or 12B. Print data to be printed with two or more colors will be printed with single pulse driving signals 57A and 57B of FIG. 9A or 12A. With this control method, when print data received from the host computer is to be printed with a single color, the print data will be printed by multi-pulse driving signals 57A and 57B.

In the above-described embodiments, the black color print head 21 is driven during the facsimile mode. However, one of the print heads 22–24 of other remaining three colors (cyan, magenta, and yellow) may be driven during the facsimile mode to perform monochromatic printing operation with a corresponding single color.

The second embodiment can be applied to the first, third, and fourth embodiments. That is, the voltage changing process of S122 can be added after the pulse number changing process of S130. The other voltage changing process of S114 can be added after the other pulse number changing process of S112.

During the facsimile mode, control may be additionally performed to increase the amount of ink in each ink droplet ejected from a single nozzle. For example, the pulsewidth of each pulse in the print clock signals 57A and 57B (driving signals) may be increased. The waveform of the print clock signals 57A and 57B (driving signals) may be changed. Or, other various methods can be employed to increase the amount of ink in each ink droplet. Each of the print clock signals 57A and 57B (driving signals) may be constructed from three or more pulser.

In the above-described embodiments, each print head is of a shear mode type print head employing the piezoelectric ceramics. However, the present invention can be applied to ether types of printing devices, for example, of a so-called Keizer ink-jet type, of a thermal ink-jet type, and the like. The present invention can be applied to printing devices of various types other than the ink-jet head type.

The printing device of the present invention may be constructed from a combination of: a data generator (host computer) for generating image data; and a printing portion having facsimile function. A control portion, including a CPU, employed in the data generator may be designed to perform the control operation of the above-described embodiments. In this case, a program, executed by the CPU to control the data generator to execute the above-described control operations, may be supplied in the form of a program stored in a data recording medium, such as a magnetic recording medium, from which data is readable by the host computer.

As described above, according to the embodiments of the present invention, the printing device is designed as capable of printing desired print information onto print medium both in a single color and in a plurality of colors. The printing device receives print information desired to be printed. It is judged whether the received print information is of a first type and a second type. The print information of the first type is such information that will possibly be printed with a plurality of colors and a single color. The print information of the second type is such information that can be printed only with a single color. According to the printing device of the present embodiments, when the received print information is of the second type, printing operation is controlled to perform printing operation while changing print density of a predetermined single color, with which the second information is to be printed, to be higher than a print density of the same predetermined color, with which the first type print information is printed.

If a monochromatic printing operation is performed to print an image at a print density that same as that of a full color printing operation, the print density of the obtained monochromatic image will possibly appear lower than that of the obtained full color image. According to the embodiments, therefore, the printing operation for the second type print information is performed to print a monochromatic image at a print density higher than that for printing the first type print information. It becomes possible to prevent the second type information from being printed to appear thinner than the first type information printed by a plurality of colors.

In the above-described embodiments, when receiving, from a telephone circuit, facsimile data to be printed in blank ink only, control is performed so as to increase the amount of the black color ink to be attached onto the print paper. Accordingly, an image obtained for the facsimile data will not appear thinner than images printed for print data received from a host computer.

Especially, in the above-described embodiments, the print head is designed to be driven, in response to a driving signal, to print the received print information onto print medium. Control is performed to switch the driving signal between a first driving signal comprised of a first number of pulses and a second driving signal comprised of a second number of pulses. The second number is greater than the first number. That is, when the received print information is of the second type, the second driving signal is applied to the print head. When the received print information is of the first type, the first driving signal is applied to the print head.

Especially, according to the above-described embodiments, the plurality of print heads are provided in correspondence with the plurality of colors. Each print head is formed with: a plurality of ink channels for accommodating ink supplied from an ink supply source; a plurality of nozzles provided in fluid communication with the respective ink channel; and a plurality of actuator portions provided in correspondence with the respective ink channels. Each actuator portion is driven by a driving signal to change the pressure occurring within the corresponding ink channel and to eject ink from the ink channel through the corresponding nozzle toward the print medium. In other words, each actuator portion serves to be actuated, in response to the driving signal, to generate energy for changing the volume of the corresponding ink channel and to eject ink from that ink channel. A driving circuit is provided to selectively supply the driving signals to the actuators of each print head. With this structure, a plurality of ink droplets are ejected from the nozzles of one or more print heads, thereby creating dots of ink on the print medium to reproduce the received print information.

According to the embodiments, when it is judged that the received print information is of the second type to be printed with the predetermined single color, the driving circuit controls the driving signals, to be supplied to one print head for printing the predetermined single color, differently from the driving signals supplied to the same print head to print the first type information. The driving signals are controlled so that the amount of ink, to be ejected from the subject print head to print a single set of the second type information, will become larger than that of ink, to be ejected from the same print head to print each set of first type information.

According to the above-described embodiments, the driving signal, for driving each actuator portion to print a single set of print information, is in the form of one or more pulses. The actuator portion will be actuated one or more times in correspondence with the number of the pulses included in the driving signal. According to the first, third and fourth embodiments, the number of the pulses included in the driving signal is switched between a first number and a second number which is higher than the first number according to the type of the received print information. In other words, the driving signal is switched between the first driving signal and the second driving signal. When the received print information is of the second information, the driving circuit produces the second driving signal constituted from the second number of pulses. When the received print information is of the first information, the driving circuit produces the first driving signal constituted from the first number of pulses.

Accordingly, when receiving the second type information, the number of pulses, to be supplied to the print head of the predetermined color for printing each set of the second type information, becomes higher than the number of pulses to be supplied to the same print head for printing each set of the first type information. Thus, the number of times, that the actuator portion is driven for printing each set of second type print information, becomes higher than that for the first type print information. Accordingly, it is possible to increase the total amount of ink, to be ejected for printing each set of the second type print information, thereby increasing the print density for the second type print information.

Especially, according to the third and fourth embodiments, frequency of the second driving signals is set lower than the frequency of the first driving signals. Because the frequency of the second driving signal is set lower than that of the first driving signal, it is possible to set the time interval, between the successive second driving signals, to be longer than that in the first driving signals. Load on the driving circuit is decreased, thereby suppressing heat generated in the driving circuit.

Especially, according to the fourth embodiment, a ratio of a printing amount, to be printed with the received print information, with respect to a predetermined printing area is detected based on the received print information. The frequency of the second driving signals is set to be lower than that of the first driving signals only when the detected ratio exceeds a predetermined value. The load on the driving circuit increases in proportion to the ratio of the printing amount with respect to the printing area. Accordingly, only when the ratio exceeds the predetermined value, the frequency of the second driving signals is set to be lower than that of the first driving signals, thereby decreasing the lead on the driving circuit and suppressing heat generation. When the detected ratio does not exceed the predetermined value, on the other hand, the print head will be driven with the basis frequency, thereby performing printing operation with a high speed.

In the above-described example, the printing amount is calculated by the CPU based on print data supplied from the host computer or the facsimile data transmitted from the telephone circuit. When the calculated result exceeds the predetermined value, the driving signal frequency is set to the lower value, thereby suppressing heat generation in the head driver IC (driving means).

The amount of ink ejected from each ink channel corresponds to the pressure occurring within the ink channel. The pressure occurring within the ink channel corresponds to the amount of an electric voltage of the driving signal applied to the actuator portion. According to the second embodiment, therefore, the amount of the driving signal electric voltage is switched between a first amount and a second amount larger than the first amount according to the type of the received print information. That is, when the received print information is of the second type, the amount of the electric voltage applied to each actuator portion in the print head of the predetermined color is set to the second amount. When the received print information is of the first type, on the other hand, the amount of the electric voltage applied to each actuator portion in the print head of the predetermined color is set to the first amount. With this structure, when desiring to print second type information, the amount of the driving signal electric voltage is increased, thereby increasing the amount of ink to be ejected and increasing the print density.

The present invention is especially suitable when the predetermined color is black color. This is because even when a black color image portion with a low print density is included in a full color image, the black color image portion does not appear too thin. However, when the image is printed with black color only at the same density, the obtained image appears too thin. In addition, there are many cases where print information is desired to be printed with black color only. Accordingly, it is desirable to increase the print density for black color printing.

According to the above-described embodiments, the printing device is provided with the modem to receive facsimile information from a telephone circuit. When receiving facsimile information received by the modem, control is performed to print the facsimile information with the predetermined single color at a print density higher than that for printing the first print information with the same single color.

Facsimile data, received from the telephone circuit, is generally comprised of much amount of character data and image data to be printed with black ink. Thus, facsimile information is generally desired to be printed with the single color. According to the present embodiment, the facsimile data is printed with print density higher than that for print data supplied from the host computer, thereby preventing the facsimile data from appearing thinner than the print data.

According to the modification, it is judged whether the received print information is of the first type to be printed with a plurality of colors or of the second type to be printed with a single color. When the received information is of the second type, control is performed to print the second type information with the predetermined single color at a print density higher than that for printing the first print information with the predetermined single color.

When a solid image is printed with a plurality of colors, the solid image is comprised of a mixture of a plurality of single color dots and a plurality of two or more color-united dots. Each single color dot is comprised of a single ink droplet of a single color. Each two or more color-united dot is comprised of two or more ink droplets of two or more colors. The two or more color-united dot has a size larger than the single color dot. Accordingly, the full color solid image presents a sufficiently high print density. Contrarily, when a solid image is printed with a single color only, the solid image is comprised of a plurality of single color dots only. Accordingly, the monochromatic solid image may possibly present print density lower than that of the full color solid image. However, according to the modification, when printing a monochromatic image, control is performed to set the print density to be higher than that of the same color portion in the full color image. The monochromatic print image will not have density lower than that of the full color print image.

What is claimed is:

1. A printing device capable of printing desired print information onto print medium, the device comprising:

input means for receiving print information desired to be printed;

print means for printing the received print information on a print medium;

density control means for controlling the print means to print the received print information at a print density while selectively controlling the print density into either a first print density or a second print density different from the first print density; and judging means for judging whether the received print information is of a first type or of a second type different from the first type, the density control means controlling the print means to perform printing operation while controlling the print density, the density control means controlling the print means to print the received pint information at the first print density when the received print information is judged to be of the first type, the density control means controlling the print means to print the received print information at the second print density when the received print information is judged to be of the second type, the second print density being different from the first print density;

wherein the print information of the first type includes both information to be printed with a plurality of colors and information to be printed with a single predetermined color, the print information of the second type including information to be printed with the single predetermined color only; and wherein the density control means controls, when the received print information is judged to be of the second type, the print means to perform printing operation while adjusting print density of the single predetermined color, with which the second type information is to be printed, to the second print density, the density control means controlling, when the received print information is judged to be of the first type, the print means to perform printing operation while adjusting print density of the single predetermined color, with which the first type information is to be printed, to the first print density, the second print density being higher than the first print density;

wherein the print means includes;

a plurality of print heads capable of printing images at the plurality of colors, each print head including;

a plurality of ink channels for accommodating ink of a corresponding color supplied from an ink supply source;

a plurality of nozzles provided in fluid communication with the respective ink channels; and a plurality of actuator portions provided in correspondence with the respective ink channels, each actuator portion being driven by a driving signal to change the pressure occurring within the corresponding ink channel and to eject the corresponding color ink from the ink channel through the corresponding nozzle toward the print medium;

driving means for selectively supplying the driving signals to the actuator portion of each print head, thereby selectively allowing the nozzles of each print head in eject ink droplets of the corresponding color and creating dots of ink on the print medium to reproduce the received print information; and wherein the density control means controls, when the received print information is judged to be of the second type, the driving means to selectively supply the driving signal of a second type, to one print head for printing the single predetermined color, thereby controlling the print head to eject a second amount of ink through a selected nozzle to print a dot for representing a single set of the second type information, the density control means controlling, when the received print information is judged to be of the first type, the driving means to selectively supply the driving signal of a first type, to the print head for printing the predetermined single color, thereby controlling the print head to eject a first amount of ink through a selected nozzle to print a dot for representing a single set of the first type information, the second amount being larger than the first amount; and wherein the first type of driving signal, for driving a selected actuator portion to print a dot indicative of a single set of the first type print information, includes at least one driving pulse, the at least one driving pulse allowing the selected actuator portion to eject at least one ink droplet to produce the subject dot, the second type of driving signal, for driving a selected actuator portion to print a dot indicative of a single set of the second type print information, includes at least two driving pulses, the at least two driving pulses allowing the selected actuator portion to eject at least two ink droplets to produce the subject dot, the number of the driving pulses included in the second type of driving signal being greater than the number of the driving pulses included in the first type of driving signal.

2. A printing device as claimed in claim 1, wherein the driving means includes:

print clock supplying means for repeatedly outputting a print cloth pulses; and driving signal generating means for receiving both the print clock pulse and each set of the received print information, the driving signal generating means outputting each set of the received print information at a timing when receiving each print clock pulse, thereby creating the driving signal for printing the corresponding set of the received print information;

wherein the density control means controls the number of times, when the print clock supplying means supplies the print clock pulse to the driving signal generating means while the driving signal generating means receives each set of the second type of print information, to be greater than the number of times, when the print clock supplying means supplies the print clock pulse to the driving signal generating means while the driving signal generating means receives each set of the first type of print information.

3. A printing device as claimed in claim 1, wherein the at least one driving pulse in the first type of driving signal, for driving the selected actuator portion to print a dot indicative of a single set of the first type print information, has an electric voltage of a first value, the at least one driving pulse with the electric voltage of the first value allowing the selected actuator portion to eject at least one ink droplets, each having a first droplet amount, to produce the subject dot of the entire first ink amount, the at least two driving pulses in the second type of driving signal, for driving the selected actuator portion to print a dot indicative of a single set of the second type print information, has an electric voltage of a second value, the at least two driving pulses with the electric voltage of the second value allowing the selected actuator portion to eject at least two ink droplets, each having a second droplet amount, to produce the subject dot of the entire second ink amount, the second value being higher than the first value.

4. A printing device as claimed in claim 3, wherein the driving means includes:

print clock supplying means for repeatedly outputting a print clock pulse; and driving signal generating means for receiving both the print clock pulse and each set of the received print information, the driving signal generating means outputting each set of the received print information at a timing when receiving each print clock pulses, thereby creating the driving signal for printing the corresponding set of the received print information;

wherein the density control means controls the amount of voltage of the driving signal, to be generated while the driving signal generating means receives each set of the second type of print information, to be higher than the voltage of the driving signal, to be generated while the driving signal generating means receives each set of the first type of print information.

5. A printing device as claimed in claim 1, wherein the predetermined color is black color.

6. A printing device as claimed in claim 1, wherein the input means includes facsimile input means for receiving facsimile information from remote communication machines, the second type of print information includes facsimile information received by the facsimile input means.

7. A printing device as claimed in claim 1, wherein the density control means controls the driving means to generate successive sets of the driving signals of the first type to print successive sets of the received print information of the first type when the received print information is judged to be of the first type, and to generate successive sets of the driving signals of the second type to print successive sets of the received print information of the second type when the received print information is judged to be of the second types; and wherein the density control means further includes frequency control means for controlling the frequency, at which the density control means controls the driving means to generate successive sets of the driving signals of the first type, into a first frequency, and for controlling the frequency, at which the density control means controls the driving means to generate successive sets of the driving signals of the second type, into a second frequency, the second frequency being lower than the first frequency.

8. A printing device as claimed in claim 7, wherein the driving means includes:

print clock supplying means for repeatedly outputting a print clock pulse; and an AND circuits for receiving both the print clock pulse and successive sets of the received print information, the AND circuit outputting each set of the successive sets of the received print information at a timing when receiving a corresponding print clock pulse; thereby creating the driving signal for printing the corresponding set of the received print information;

wherein the density control means controls the print clock supplying means to set a second number of times, when the print clock supplying means supplies the print clock pulse to the AND circuit while the AND circuit receives each set of the second type of print information, to be greater than a first number of times, when the print clock supplying means supplies the print clock pulse to the AND circuit while the AND circuit receives each set of the first type of print information; the density control means further controlling the print clock supplying means to set the second frequency, at which the print clock supplying means repetitively supplies the second number of print clock pulses in correspondence with the successive sets of the second type of print information, to be lower than the first frequency, at which the print clock supplying means repetitively supplies the first number of print clock pulse in correspondence with the successive sets of the first type of print information.

9. A printing device as claimed in claim 7, wherein the frequency control means includes:

detection means for detecting, when the received print information is judged to be of the second type, a ratio of a printing amount, to be printed with the received print information of the second type, with respect to a predetermined print area on the printing medium based on the received print information of the second type;

wherein the frequency control means controls the driving means to generate the successive sets of the driving signal of the second type at the second frequency when the detected ratio exceeds a predetermined value, and controls the driving means to generate the successive sets of the driving signal of the second type of that the first frequency when the detected ratio does not exceed the predetermined value.

10. A printing device capable of printing desired print information onto print medium both in a single color and in a plurality of colors, the device comprising:

input means for receiving print information desired to be printed;

judging means for judging whether the received print information is of a first type print information which includes image information to be printed with a plurality of colors and image information to be printed with a single predetermined color or of a second type print information to be printed with the single predetermined color;

print density adjusting means for adjusting print density of the predetermined color into first print density when the received print information is judged to be the first type and for adjusting print density of the predetermined color into second print density when the received print information is judged to be the second type, the second print density being higher than the first print density; and print means for printing the predetermined color of the received first type of print information at the first printing density and for printing the predetermined color of the received second type of print information at the second printing density;

wherein the print means includes;

a plurality of print heads in correspondence with the plurality of colors, each print head including;

a plurality of ink channels for accommodating ink at a corresponding color supplied from an ink supply source;

a plurality of nozzles of fluid communicating with the plurality of ink channels; and a plurality of actuator portions, each for being driven by a driven by a driving signal to change the pressure occurring in the corresponding ink channel, thereby electing ink of the corresponding color from the corresponding ink channel through the corresponding nozzle toward a print medium; and driving means for selectively supplying a driving signal, in response to each set of the received print information, to a corresponding actuator portion in each print head, thereby allowing the actuator portion to selectively eject ink to print each set of the received print information on the print medium;

wherein the print density adjusting mean includes ink amount changing means for controlling the driving signal to be supplied to the print head of the predetermined color into a first driving signal when the judging means judges that the received print information is of the first type, and for controlling the driving signal to be supplied to the print head of the predetermined color into a second driving signal when the judging means judges that the received print information is of the second type, the first driving signal driving the corresponding actuator portion to change the pressure occurring within the corresponding ink channel to eject ink of a first amount from the ink channel, the second driving signal driving the corresponding actuator portion to change the pressure according within the corresponding ink channel to eject ink of a second amount from the ink channel, the second amount being larger than the first amount; and wherein the driving means includes deriving pulse signal generating means for selectively supplying at least one first driving pulse signal, in response to each set of the received first type print information, to a corresponding actuator portion in a corresponding print head, thereby allowing the actuator portion to selectively actuate in correspondence with the first driving pulse signal to thereby selectively eject ink the number of times the first driving pulse signal is supplied, and for selectively supplying at least one second driving pulse signal, in response to each set of the received second type print information, to a corresponding actuator portion in a corresponding print head, thereby allowing the actuator portion to selectively actuate in correspondence with the second driving pulse signal to thereby selectively eject ink the number of times the second driving pulse signal is supplied;

wherein the ink amount changing means includes pulse number control means for controlling the number of the first driving pulse signal, to be supplied to the print head of the predetermined color for printing each set of the received print information, into a first number, and for controlling the number of the second driving pulse signal, to be supplied to the print head of the predetermined color for printing each set of the received print information, into a second number, the first driving pulse signal driving the corresponding actuator portion the first number of times to thereby eject ink the first number of times from the ink channel, the second driving pulse signal driving the corresponding actuator portion the second number of times to thereby eject ink the second number of times from the ink channel, the second number being greater than the first number.

11. A printing device as claimed in claim 10, wherein the amount of ink ejected from the ink channel corresponds to the pressure occurring within the ink channel, the pressure within the ink channel corresponding to the amount of an electric voltage of the driving signal applied to the actuator portion;

and wherein the ink amount changing means further includes voltage changing means for changing the electric voltage of the first driving pulse signal into a first value when the judging means judges that the print information is the first type information, and for changing the electric voltage of the second driving pulse signal into a second value when the judging means judges that the print information is the second type information, the second value being higher than the first value.

12. A printing device as claimed in claim 10, wherein the predetermined color is black color.

13. A printing device as claimed in claim 10, wherein the input means includes facsimile communication means capable of receiving facsimile information from a telephone circuit;

wherein the judging means determines that facsimile information received by the facsimile communication means is the second print information; and wherein the print density adjusting means changes the print density of the predetermined color for printing the received facsimile information to be higher than the density of the predetermined color for printing the first type print information.

14. A printing device as claimed in claim 10, wherein the first type print information is to be printed with the plurality of colors, and the second type print information is to be printed with the single predetermined color; and wherein the print density adjusting means adjusts the print density of the predetermined color for printing the second type print information to be higher than the density of the predetermined color for printing the first type print information.

15. A printing device, comprising:

input means for receiving print information;

a print head for being driven, in response to a driving pulse signal, to print the received print information onto print medium;

driving means for selectively supplying either first driving pulse signals or second driving pulse signals to the print head in correspondence with successive sets of print information, each first driving pulse signal for printing a corresponding set of print information being comprised of at least one pulse, the second driving pulse signal for printing a corresponding set of print information being comprised of a plurality of successive pulses, the number of the pulses in the second driving pulse signal being greater than the number of the at least one pulse in the first driving pulse signal; and frequency control means for controlling a second frequency, at which the driving means supplies the successive second driving pulse signals to the print head, to be lower than a first frequency, at which the driving means supplies the successive first driving pulse signals;

wherein the input means includes:

print data input means for receiving print data; and facsimile communication means for receiving facsimile information;

wherein the driving means supplies the first driving pulse signals to the print head when the print data is received by the print data input means, and supplies the second driving pulse signals to the print head when the facsimile information is received by the facsimile communication means.

16. A print device as claimed in claim 15, wherein the frequency control means includes:

detection means for detecting a ratio of a printing amount, of the received print information to be printed, with respect to a predetermined printing area of the printing medium based on the received print information; and frequency setting means for setting the second frequency of the second driving pulse signals to be lower than that of the first driving pulse signals when the detected ratio exceeds a predetermined value.

17. A print head as claimed in claim 15, wherein the print head includes:

a plurality of ink channels for accommodating ink supplied from an ink supply source;

a plurality of nozzles in fluid communication with the ink channels; and a plurality of energy generating portions provided for the plurality of ink channels, each energy generating portion being driving by the driving pulse signal to change a volume of the corresponding ink channel, thereby ejecting ink from the ink channel through the nozzle toward the print medium; and wherein the driving means selectively supplies either the first driving pulse signals or the second driving pulse signals to the energy generating portions.

18. A printing device, comprising:

input means for receiving print information;

a print head for being driven, in response to a driving pulse signal, to print the received print information onto print medium;

driving means for selectively supplying either first driving pulse signals or second driving pulse signals to the print head in correspondence with successive sets of print information, each first driving pulse signal for printing a corresponding set of print information being comprised of at least one pulse, the second driving pulse signal for printing a corresponding set of print information being comprised of a plurality of successive pulses, the number of the pulses in the second driving pulse signal being greater than the number of the at least one pulse in the first driving pulse signal; and frequency control means for controlling a second frequency, at which the driving means supplies the successive second driving pulse signals to the print head, to be lower than a first frequency, at which the driving means supplies the successive for driving pulse signals;

wherein the input means is capable of receiving full-color print information to be printed with a plurality of colors and monochromatic print information to be printed with a single color; and wherein the driving means supplies the first driving pulse signals to the print head when the full-color print information is received, and supplies the second driving pulse signals to the print head when the monochromatic print information is received.

19. A print device as claimed in claim 18, wherein the frequency control means includes:

detection means for detecting a ratio of a printing amount, of the received print information to be printed, with respect to a predetermined printing area of the printing medium based on the received print information; and frequency setting means for setting the second frequency of the second driving pulse signals to be lower than that of the first driving pulse signals when the detected ratio exceeds a predetermined value.

20. A print head as claimed in claim 18, wherein the print head includes:

a plurality of ink channels for accommodating ink supplied from an ink supply source;

a plurality of nozzles in fluid communication with the ink channels; and a plurality of energy generating portions provided for the plurality of ink channels, each energy generating portion being driving by the driving pulse signal to change a volume of the corresponding ink channel, thereby ejecting ink from the ink channel through the nozzle toward the print medium; and wherein the driving means selectively supplies either the first driving pulse signals or the second driving pulse signals to the energy generating portions.

* * * * *